United States Patent [19]

Kato et al.

[11] Patent Number: 4,480,028

[45] Date of Patent: Oct. 30, 1984

[54] SILVER HALIDE COLOR PHOTOGRAPHIC LIGHT-SENSITIVE MATERIAL

[75] Inventors: Kazuo Kato; Yoshikazu Watanabe; Kenji Kumashiro; Satoru Shimba, all of Hino, Japan

[73] Assignee: Konishiroku Photo Industry Co., Ltd., Tokyo, Japan

[21] Appl. No.: 461,938

[22] Filed: Jan. 28, 1983

[30] Foreign Application Priority Data

Feb. 3, 1982 [JP] Japan ..... 57-16667

[51] Int. Cl.[3] ..... G03C 7/26

[52] U.S. Cl. ..... 430/544; 430/549; 430/553; 430/554; 430/555; 430/557; 430/558; 430/957

[58] Field of Search ..... 430/544, 554, 549, 957, 430/553, 555, 557, 558

[56] References Cited

U.S. PATENT DOCUMENTS

| | | | |
|---|---|---|---|
| 2,353,205 | 7/1944 | Vittum et al. | 430/554 |
| 3,632,345 | 1/1972 | Marx et al. | 430/566 |
| 3,869,291 | 3/1975 | Mader et al. | 430/544 |
| 3,928,041 | 12/1975 | Fujiwhara et al. | 430/443 |
| 4,187,110 | 2/1980 | Yagihara et al. | 430/544 |
| 4,273,861 | 6/1981 | Shiba et al. | 430/544 |
| 4,326,022 | 4/1982 | Ito et al. | 430/544 |
| 4,387,159 | 6/1983 | Engelmann et al. | 430/544 |

*Primary Examiner*—J. Travis Brown
*Attorney, Agent, or Firm*—Jordan B. Bierman

[57] ABSTRACT

Silver halide photographic material having at least one light sensitive silver halide emulsion layer, at least one non-light sensitive hydrophilic colloidal layer, and optionally a third type of layer, wherein at least one of said emulsion layers, colloid layers, or third type of layers has, in a single layer, both a magenta coupler of Formula I and a development inhibitor releasing compound having a development inhibitor radical of Formula II or III, said Formula is

I wherein $R_1$ is selected from benzamido, anilino, and phenylureido, each having a sulfonamido group and $R_2$ is selected from aryl and heterocyclic groups; said Formula II is

II wherein $R_3$ is selected from hydrogen, halogen, acylamino, alkyl, benzothiazolinylidenamino and phenyl substituted alkoxy; said Formula III is

III wherein X is a group of non-metallic atoms necessary to complete, together with the C═N group, a five or six membered heterocyclic ring.

10 Claims, No Drawings

SILVER HALIDE COLOR PHOTOGRAPHIC LIGHT-SENSITIVE MATERIAL

This Application claims priority under 35 USC 119 of Japanese Application No. 16667/1982, filed Feb. 3, 1982.

The present invention relates to a silver halide color photographic light-sensitive material.

It is well-known that a silver halide color photographic light-sensitive material, after being exposed to light, is processed, for example, in a color developer containing an aromatic primary amine developing agent to thereby obtain a dye image. Namely, when a silver halide color photographic light-sensitive material is exposed to light and then processed in a color developer containing an aromatic primary amine developing agent, the developing agent reduces the silver halide to produce a developed silver and at the same time the agent itself is oxidized to form an active oxidized product of the developing agent. The resulting oxidized product then reacts with couplers to thereby form dyes. The formed dyes are cyan, magenta and yellow dyes, those materials forming which dyes are cyan coupler, magenta coupler and yellow coupler, respectively. Those already known yellow couplers are open-chain ketomethylene compounds, those known cyan couplers are $\alpha$-naphthol compounds and phenol compounds, and those known magenta couplers are 5-pyrazolone compounds, pyrazolobenzimidazole compounds, a pyrazolotriazole compound, and the like.

In recent years, in the field of silver halide color photographic light-sensitive materials, couplers having a high color-developable sensitivity as well as capable of producing a high maximum color density have been demanded. As ones capable of meeting such a demand there have been known those various two-equivalent-type couplers which require the development of only two moles of a silver halide for the formation of one mole of a dye. However, in the field of magenta couplers, two-equivalent-type couplers have such disadvantages that they are as unstable as to become deteriorated with time as compared with 4-equivalent-type couplers, and the like, and therefore no such magenta couplers as capable of sufficiently meeting the above-mentioned demand still have been existed, and the development of excellent 4-equivalent couplers are rather anticipated. On the other hand, 4-equivalent 5-pyrazolone-type magenta couplers having sulfonamido radical (>N—$SO_2$—) as known in, e.g., U.S. Pat. No. 2,369,489, Japanese Patent Publication Open to Public Inspection (hereinafter referred to as Japanese Patent O.P.I. Publication) No. 29236/1981 and 44927/1976 are found to be the couplers excellent in their stability during storage and having a high color-developable sensitivity as well as producing a high maximum color density. The couplers, however, have the disadvantage that they are unstable when processed in a color developer, that is, the fog and the high maximum color density thereof produced when processed in a color developer depend largely upon the variation of the pH of the color developer.

It is therefore an object of the present invention to provide a silver halide color photographic light-sensitive material having a high color-developable sensitivity as well as capable of producing a high maximum color density and excellent in the stability thereof when processed in a color developer.

As a result of various investigations, it has now been found that the above-described object of the invention is accomplished by a silver halide color photographic light-sensitive material comprising a support having thereon at least one light-sensitive silver halide emulsion layer and at least one non-light-sensitive hydrophilic colloidal layer, the same layer or different layers of the foregoing layers containing at least one of those magenta couplers (hereinafter referred to as the magenta coupler of the invention) having the following formula [I] and at least one development inhibitor releasing compound having a development inhibitor radical represented by the following formulas [II] or [III].

Formula [I]

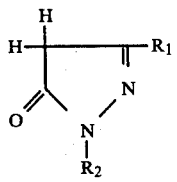

wherein $R_1$ represents benzamido, anilino or phenylureido radical each having sulfonamido (>N—$SO_2$—), and $R_2$ represents an aryl or heterocyclic radical.

Formula [II]

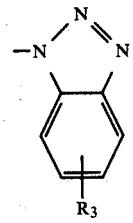

wherein $R_3$ is hydrogen, a halogen, an acylamino, an alkyl radical, or an alkoxy radical substituted by benzothiazolinylideneamino or by phenyl radical.

Formula [III]

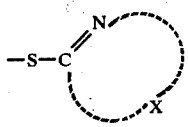

wherein X is a group of non-metallic atoms necessary to complete a 5- or 6-member heterocyclic ring.

Formula [I] will be illustrated in detail below:

The aryl radical represented by $R_2$ includes, e.g., phenyl and naphthyl radicals, and the heterocyclic radical includes, e.g., pyridyl, quinolyl, furyl, benzothiazolyl, oxazolyl, imidazolyl, naphthooxazolyl radicals. In addition, into these radicals may be introduced such a substituent as, e.g., a halogen atom, nitro, cyano, amino, an alkyl, an alkenyl, an aryl, an alkoxy, hydroxy, an aryloxy, an ester, sulfamoyl, carbamoyl, ureido, a heterocyclic, sulfonyloxy, oxo, an acylamino carboxyl, sulfonamido, alkylthio, an arylthio, or the like radical, or may also be introduced such a substituents as one of these substituents substituted further by the above similar radicals. And, particularly, as the $R_2$, those phenyls substituted by an alkyl, an alkoxy or a halogen atom at at least one of the ortho positions thereof are useful.

The magenta couplers of the present invention include those compounds having the following formulas [IV] and [V]:

Formula [IV]

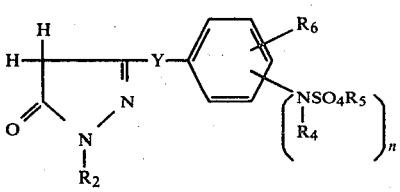

Formula [V]

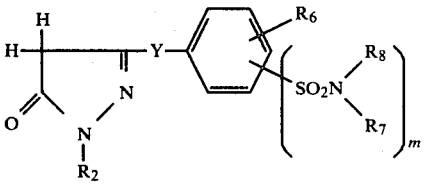

In both Formulas [IV] and [V] Y represents —NHCO— (wherein N is bonded to the pyrazolone nucleus), —NH— or —NHCONH— radical; $R_2$ is as defined in the $R_2$ of Formula [I]' $R_4$, $R_7$ and $R_8$ each is hydrogen or an alkyl radical (e.g., an alkyl having from 1 to 18 carbons atoms and allowed to have a substituent), an aryl radical (e.g., an aryl aas defined in the $R_2$ of Formula [I] or a heterocyclic radical (e.g., a heterocyclic radical as defined in the $R_2$ of Formula [I]); $R_5$ is an alkyl radical (e.g., an alkyl having from 1 to 18 carbon atoms and allowed to have a substituent), an aryl radical (e.g., an aryl as defined in the $R_2$ of Formula [I]), an alkoxy radical (e.g., an alkoxy having from 1 to 18 carbon atoms and allowed to have a substituent) or an amino radical (e.g., an amino substituted by, e.g., an alkyl or aryl having from 1 to 18 carbon atoms); $R_6$ is hydrogen or a halogen or an alkoxy radical; and n and m each is an integer of 1 or 2.

The Y herein represents preferably —NHCO— or —NH— radical. If the Y is —NHCO— radical, that is, if the $R_1$ in Formula [I] is a benzamido radical having sulfonamido radical, the $R_6$ in Formulas [IV] and [V] is more desirable to be hydrogen. If the Y is —NH— radical, that is, if the $R_1$ in Formula is an anilino radical having sulfonamido radical, the $R_6$ in Formulas [IV] and [V] is more desirable to be a halogen or an alkoxy radical (e.g., an alkoxy having from 1 to 4 carbon atoms).

The following are examples of the magenta couplers of the present invention, which should not be construed as limiting the invention thereto.

Exemplified Couplers:

M - 1

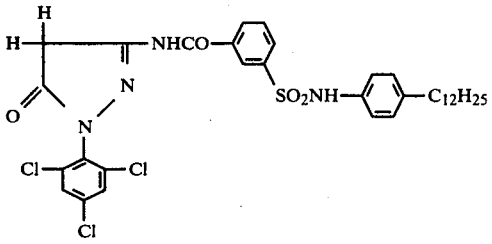

-continued

Exemplified Couplers:

M - 2

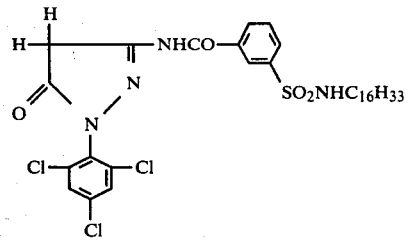

M - 3

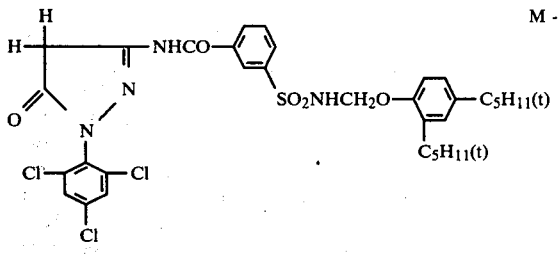

M - 4

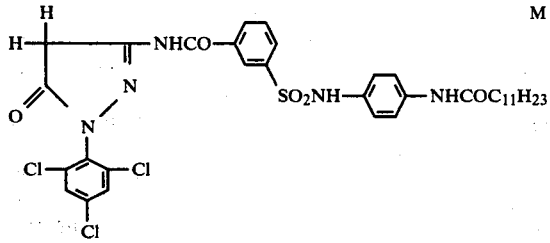

M - 5

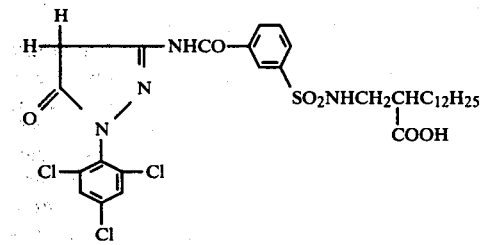

M - 6

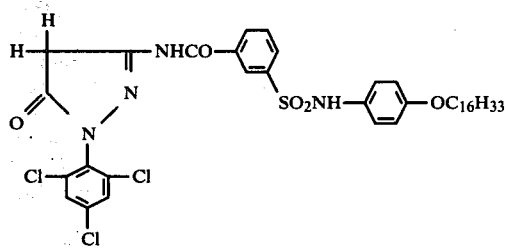

M - 7

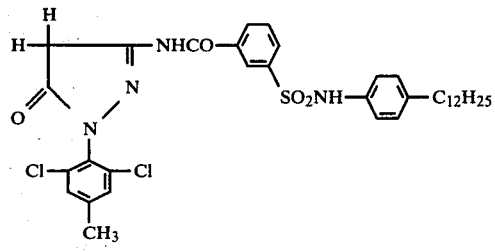

-continued
Exemplified Couplers:
M - 8
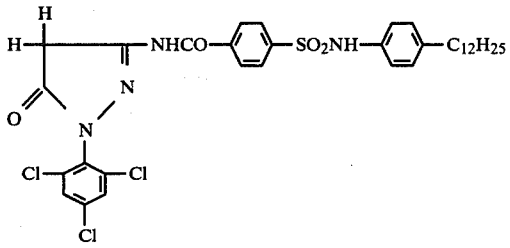
M - 9
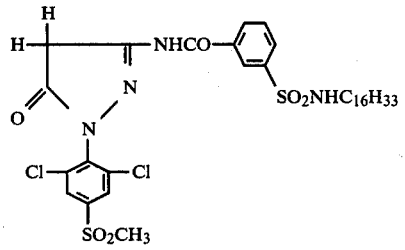
M - 10
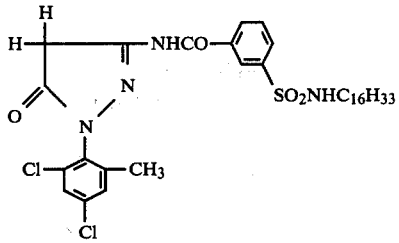
M - 11
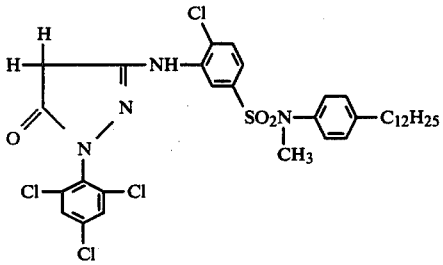
M - 12
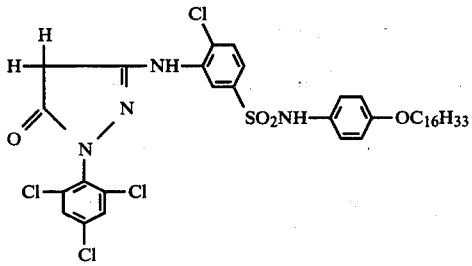
M - 13
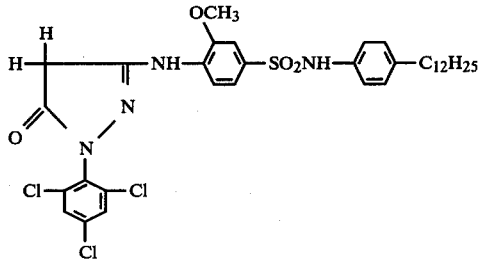
-continued
Exemplified Couplers:
M - 14
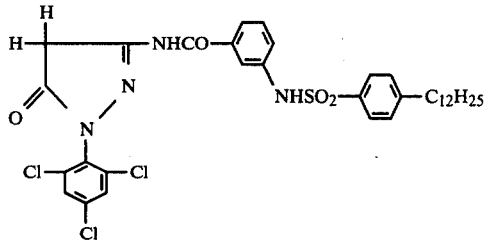
M - 15
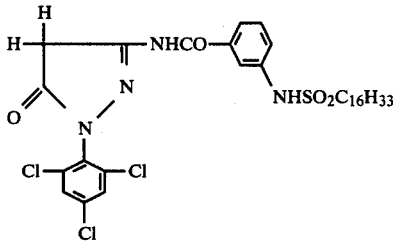
M - 16
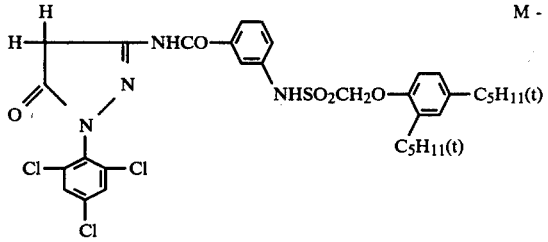
M - 17
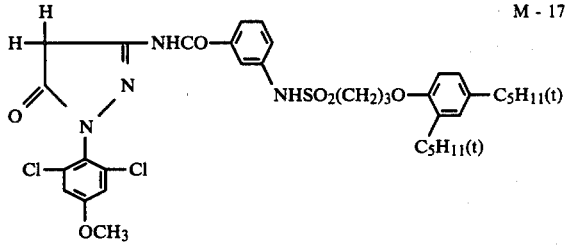
M - 18
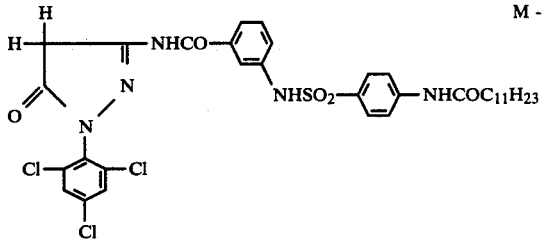
M - 19
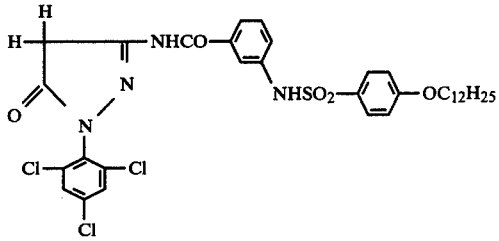

-continued
Exemplified Couplers:
M - 20
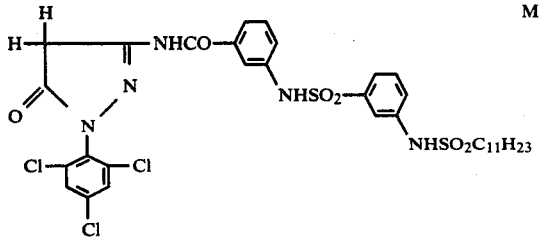
M - 21
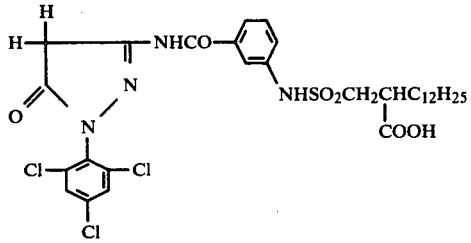
M - 22
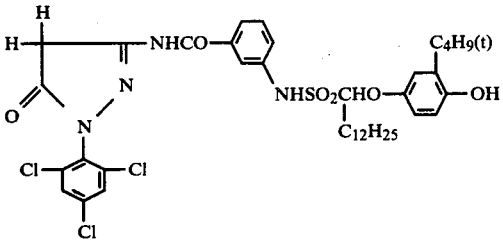
M - 23
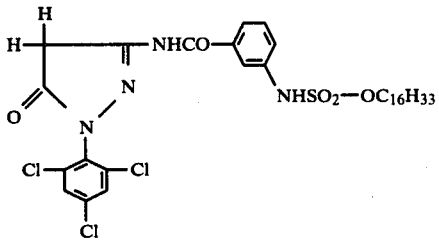
M - 24
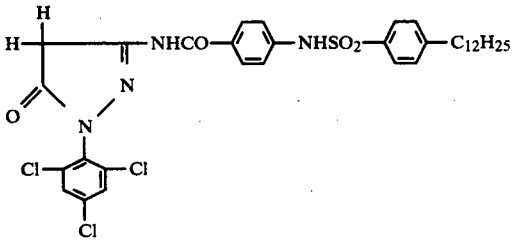
M - 25
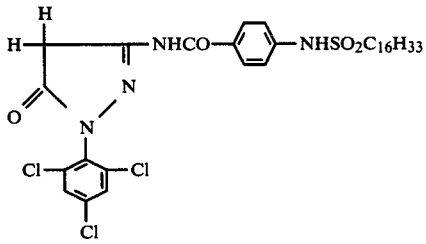
-continued
Exemplified Couplers:
M - 26
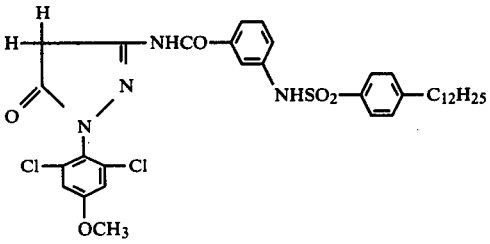
M - 27
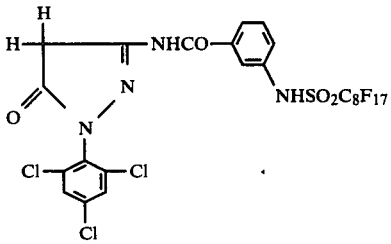
M - 28
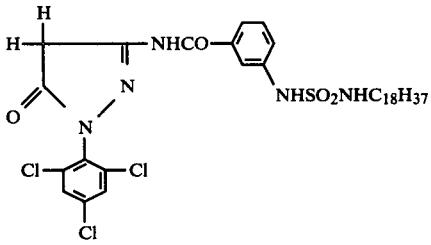
M - 29
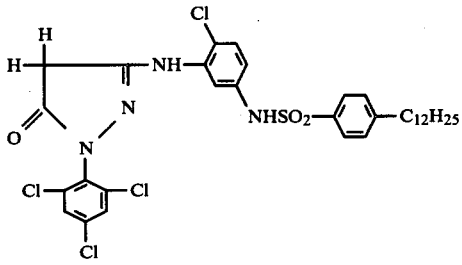
M - 30
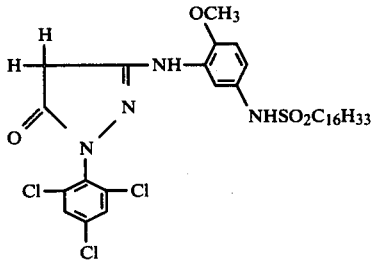
M - 31
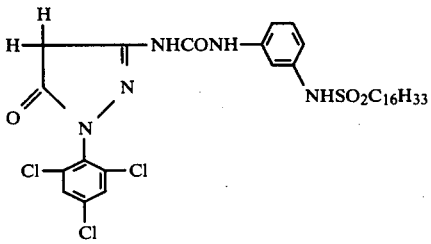

-continued
Exemplified Couplers:
M - 32
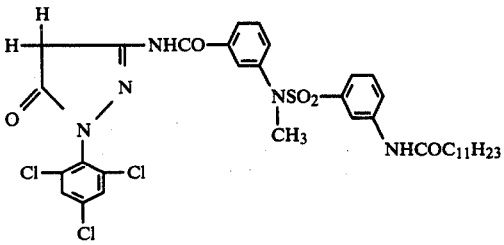
M - 33
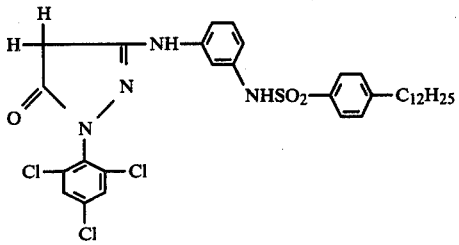
M - 34
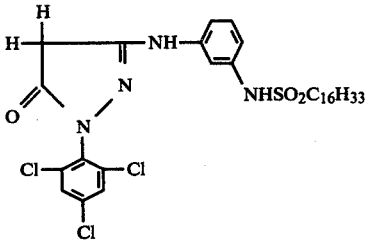
M - 35
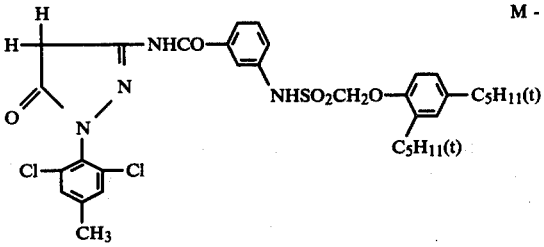
M - 36
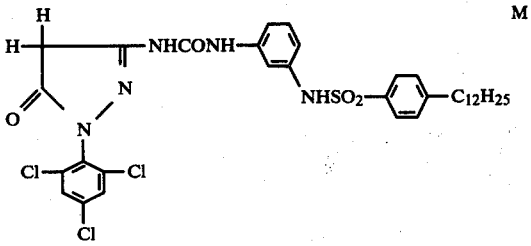
M - 37
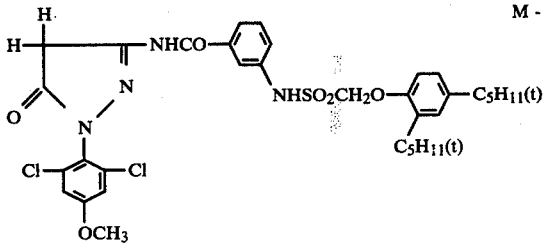
-continued
Exemplified Couplers:
M - 38
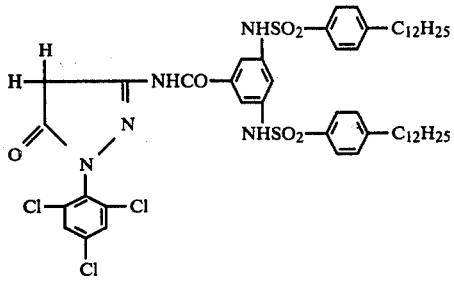
M - 39
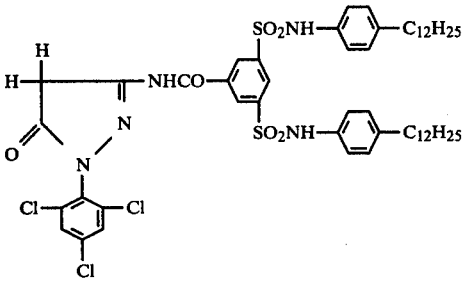
M - 40
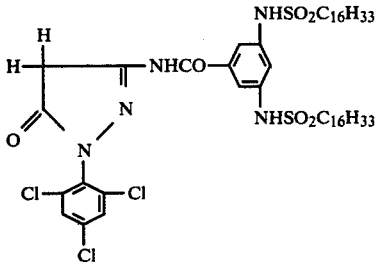
M - 41
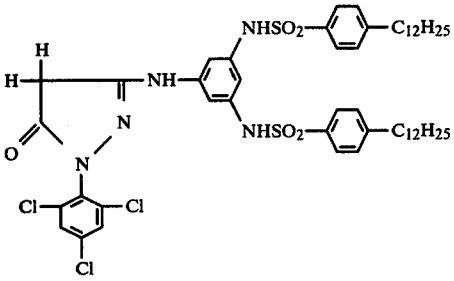
M - 42
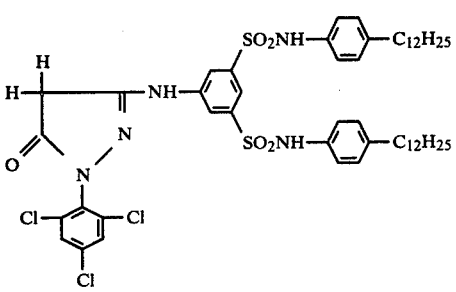

-continued

Exemplified Couplers:

M - 43

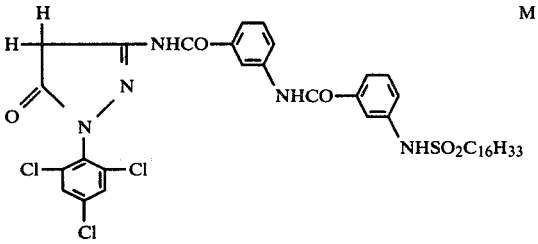

M - 44

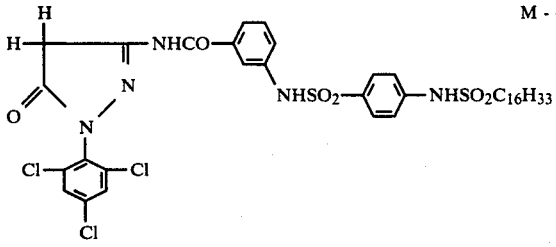

M - 45

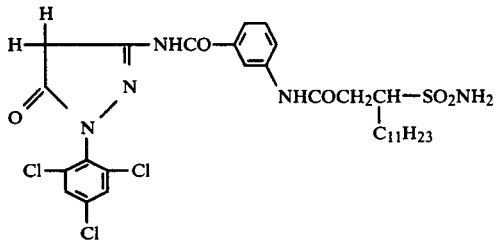

M - 46

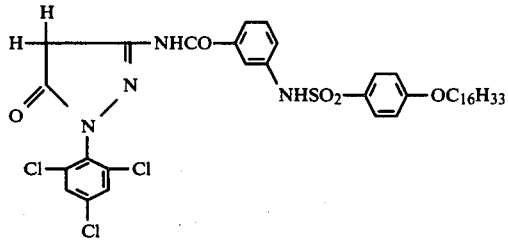

M - 47

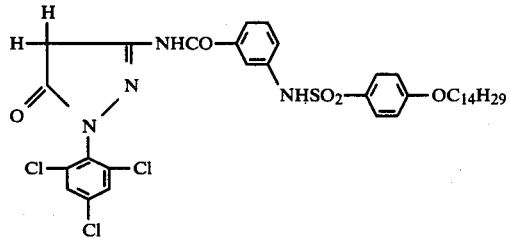

M - 48

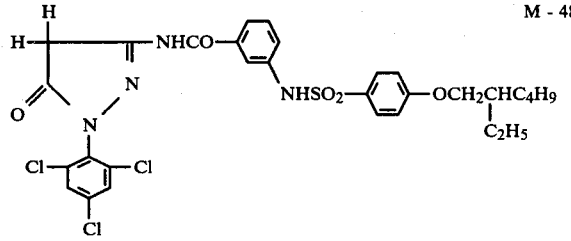

-continued

Exemplified Couplers:

M - 49

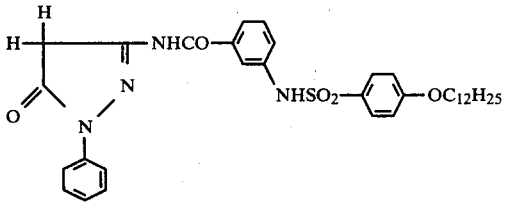

M - 50

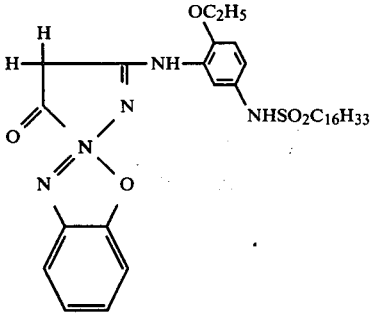

M - 51

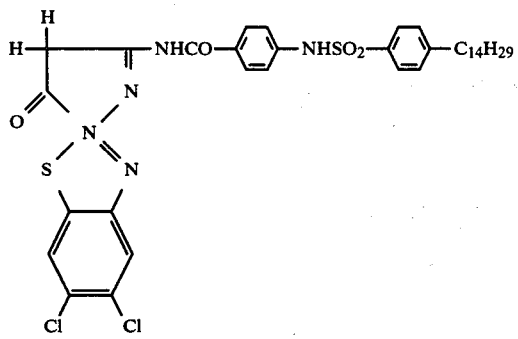

As the development inhibitor releasing compound (hereinafter referred to as DIR compound) there have been generally known those compounds including such compounds that react with the oxide of a color developing agent to thereby produce a dye as well as release a development inhibitor as described in, e.g., U.S. Pat. Nos. 3,148,062 and 3,227,554, British Pat. No. 2,010,818, and Japanese Patent O.P.I. Publication Nos. 69624/1977 and 135835/1980; such compounds that react with the oxide of a color developing agent to thereby release a development inhibitor but not form a dye as described in U.S. Pat. Nos. 3,632,345, 3,958,993, 3,938,996, 3,928,041 and 3,961,959, Japanese Patent O.P.I. Publication Nos. 67628/1977 and 6724/1976, and Japanese Patent Application No. 125202/1975; and such compounds that react with the oxide of a color developing agent to thereby release a compound which, by a intramolecular nucleophilic substitution reaction, releases a development inhibitor as described in Japanese Patent O.P.I. Publication No. 145135/1979. In addition, Japanese Patent Application No. 17644/1980 describes compounds that react with the oxide of a color developing agent to thereby release a compound that releases a development inhibitor by the electron transfer along a conjugated system.

Generally, development inhibitor radical include those as described in Research Disclosure Vol. 176 No. 17643 Dec. 1978 such as, for example, mercaptotetrazole, selenotetrazole, mercaptobenzothiazole, selenobenzothiazole, mercaptobenzoxazole, selenobenzoxazole, mercaptobenzimidazole, selenobenzimidazole, benzotriazole, benzodiazole, and derivatives of these compounds. DIR compounds are generally known to have effects for improving the graininess and sharpness due to the effect of the development inhibitor that is released during a development. DIR compounds usable in the present invention, the DIR compounds having those development inhibitor radicals represented by the aforementioned general formula [II] or [III] (hereinafter referred to as the DIR compound of the invention) have especially an effect for solving the problem of unstable change in the action of the magenta couplers of the present invention during processing. Examples of these DIR compounds having development inhibitor radicals of the present invention are described together with synthesis examples in the foregoing patent specifications.

Among the DIR compounds of the present invention, those DIR compounds having Formula [II] are also particularly effectively used for the improvement of the preservability of the magenta couplers of the present invention. Among the DIR compounds of the present invention those DIR compounds having a development inhibitor radical represented by Formula [III] have been found to not only have an effect to the change in the action of the magenta coupler in development but also have a large effect for restraining the occurrence of fog to the magenta couplers of the present invention.

Among the development inhibitor radicals of the present invention, those development inhibitor radicals having Formula [II] are preferably represented by the following general Formula [VI]:

Formula [VI]

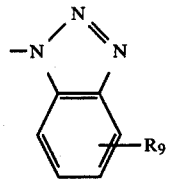

wherein $R_9$ is a halogen atom, an acylamino radical such as an alkyl-acylamino radical having from 1 to 10 carbon atoms, a benzothiazolinylidenamino radical having the formula:

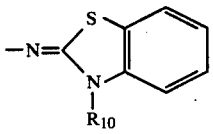

(wherein $R_{10}$ is an aryl radical or an alkyl radical having from 1 to 4 carbon atoms and allowed to be substituted by, e.g., an alkoxy, a halogen, an aryl, etc.), or a phenyl-substituted alkoxy radical such as benzyloxy, or the like.

The preferred ones of those development inhibitor radicals having Formula [III] are represented by the following general formula [VII]:

Formula [VII]

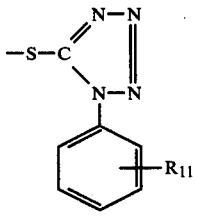

wherein $R_{11}$ is a halogen, nitro, an alkoxy such as an alkoxy having from 1 to 4 carbon atoms, an alkyl such as an alkyl having from 1 to 4 carbon atoms, amino, an acylamino such as an alkylacylamino having from 1 to 4 carbon atoms, hydroxy, carboxy, sulfo or sulfamoyl radical.

The following are typical examples of the DIR compounds having those development inhibitor radicals having Formula [II] or [III] applicable to the present invention:

D-1

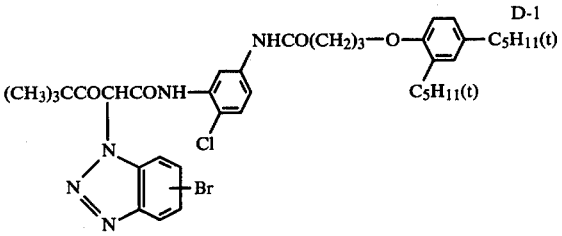

D-2

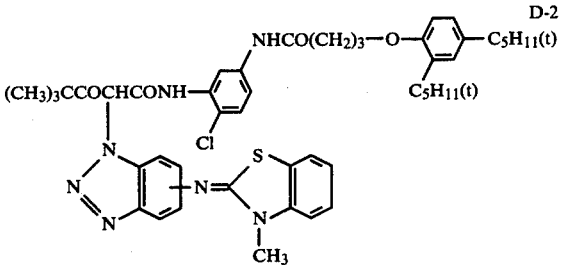

D-3

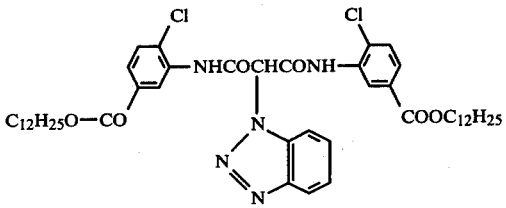

D-4

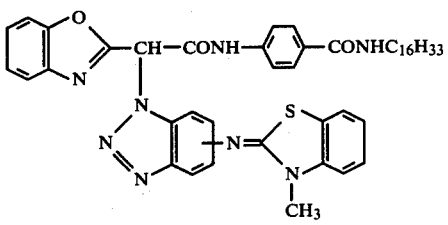

-continued
D-5
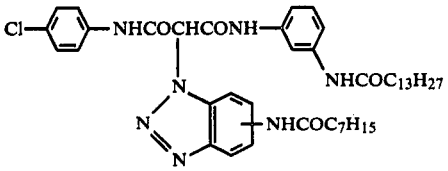
D-6
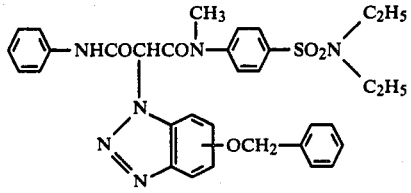
D-7
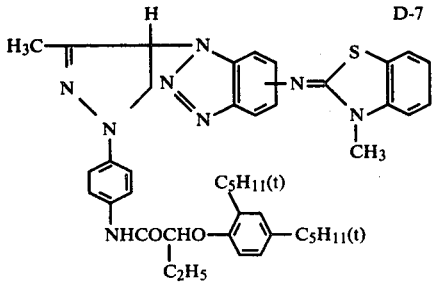
D-8
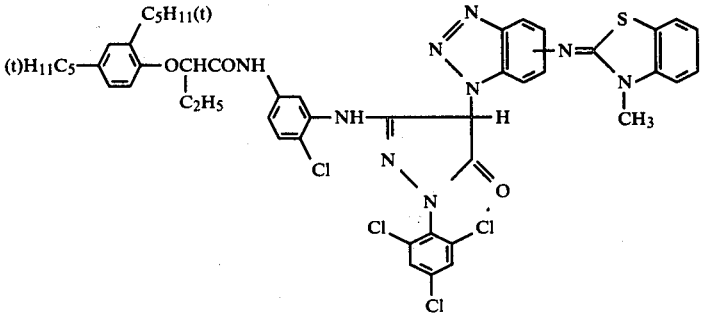
D-9
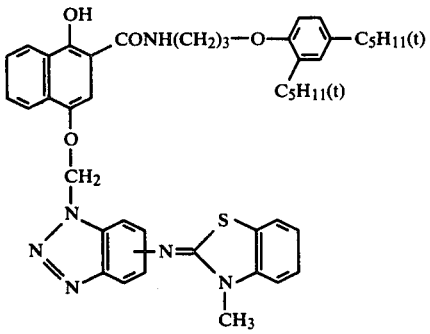
D-10
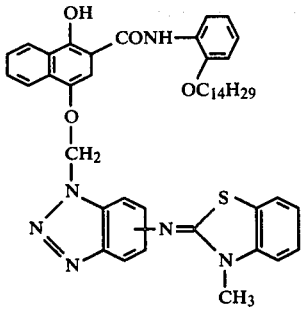
D-11
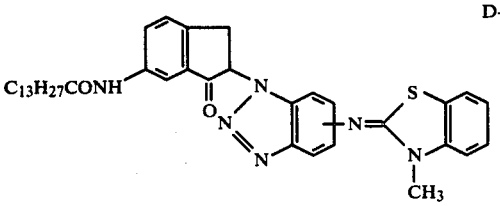
D-12
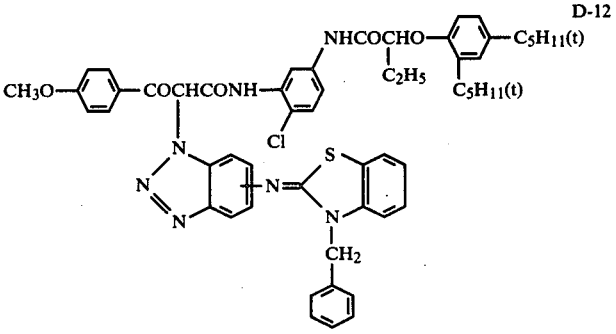
D-13
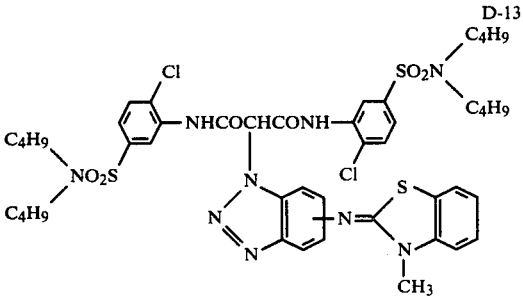
D-14
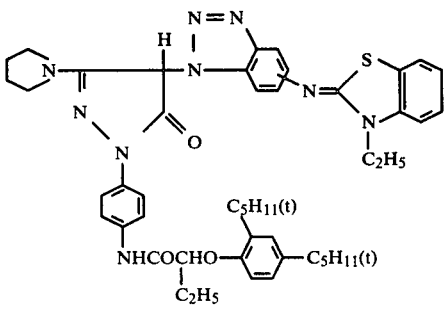

-continued
D-15
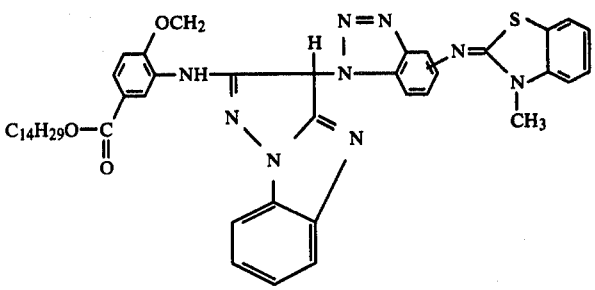
D-16
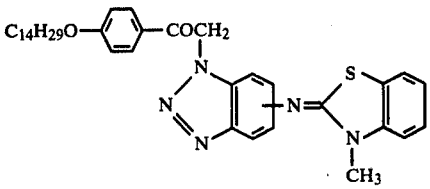
D-17
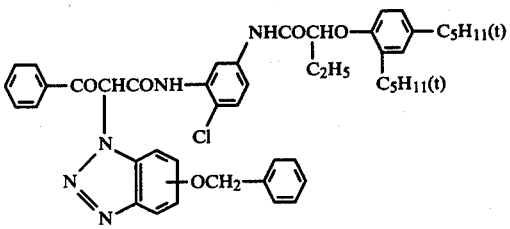
D-18
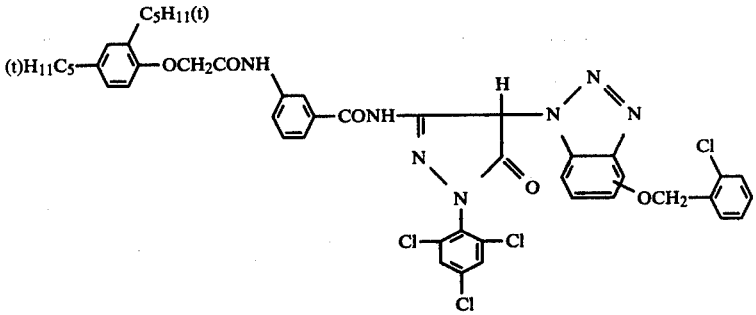
D-19
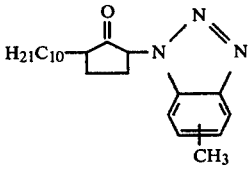
D-20
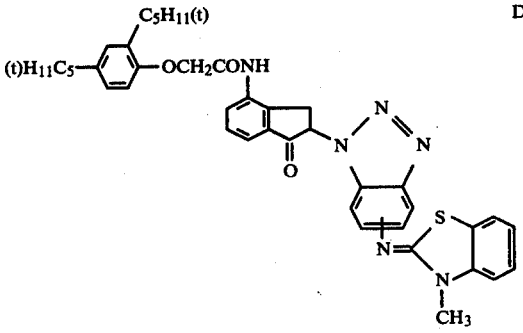
D-21
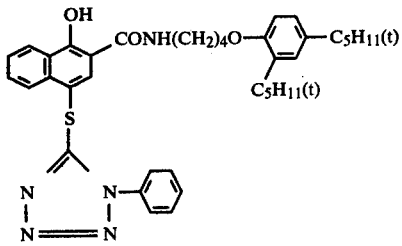
D-22
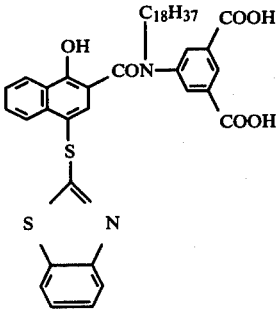
D-23
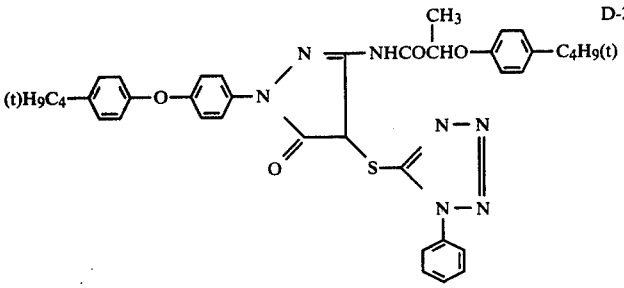

-continued
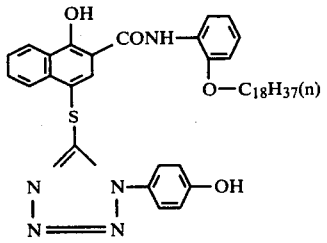
D-24
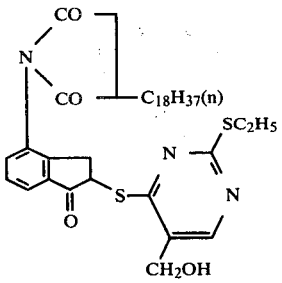
D-25
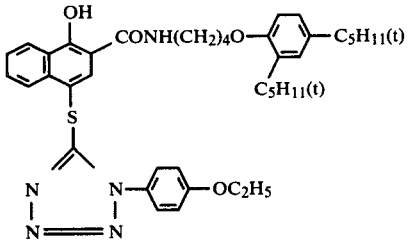
D-26
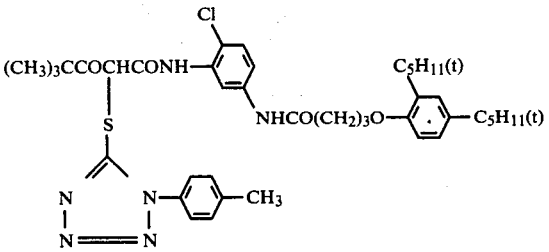
D-27
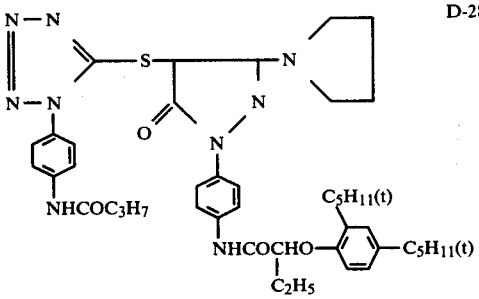
D-28
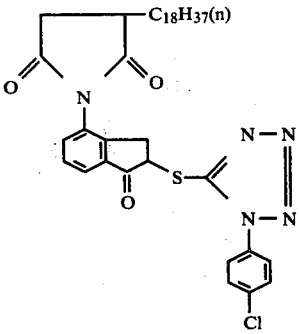
D-29
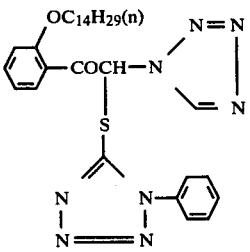
D-30
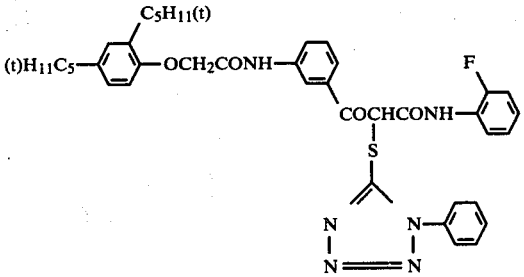
D-31
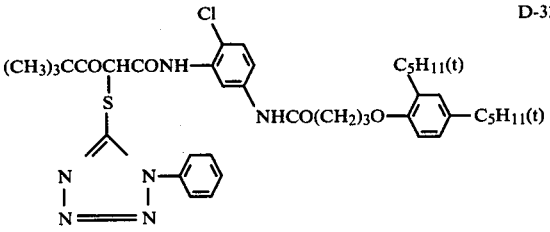
D-32
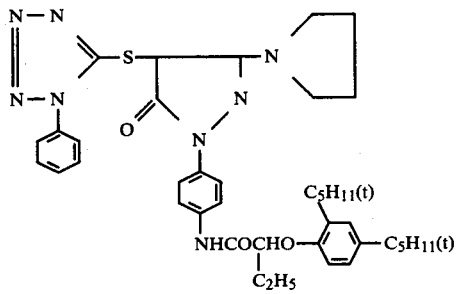
D-33

-continued
D-34
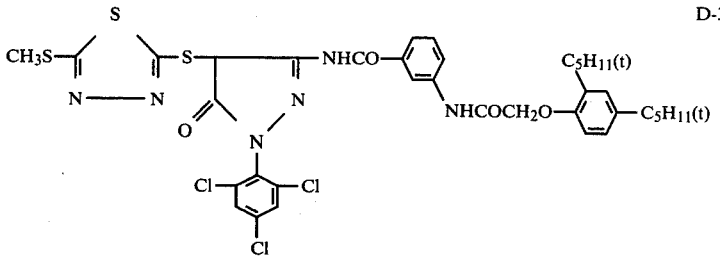
D-35
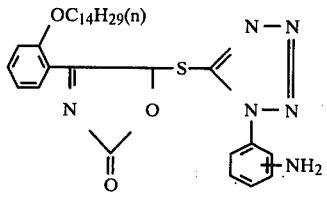
D-36
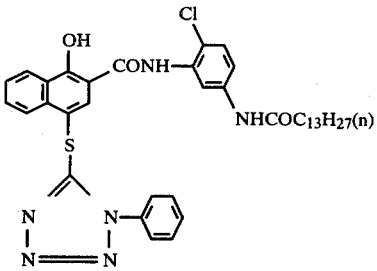
D-37
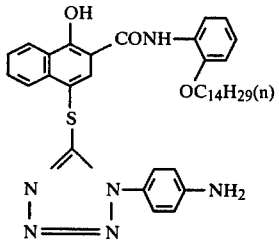
D-38
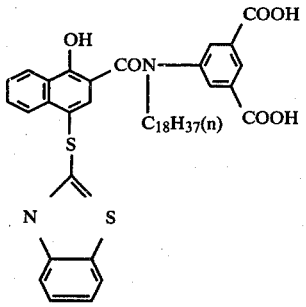
D-39
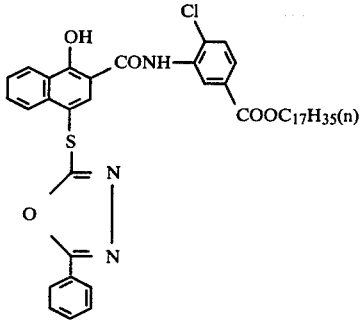
D-40
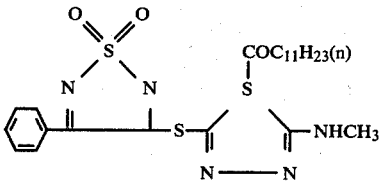
D-41
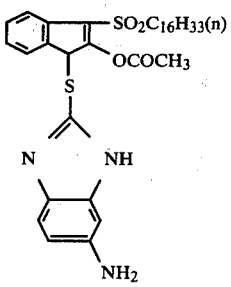
D-42
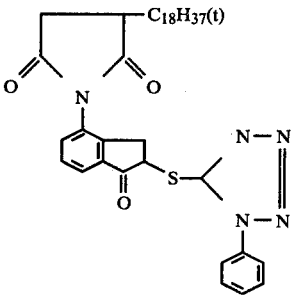
D-43
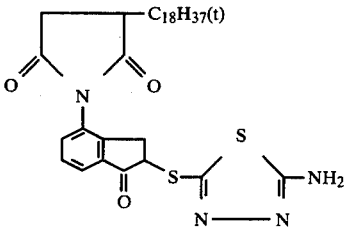

-continued
D-44
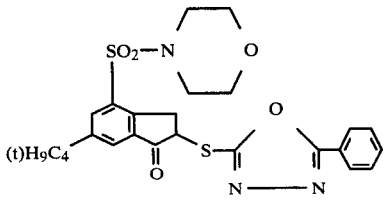
D-45
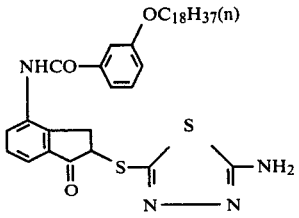
D-46
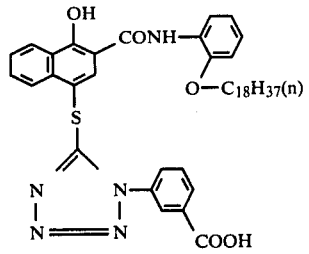
D-47
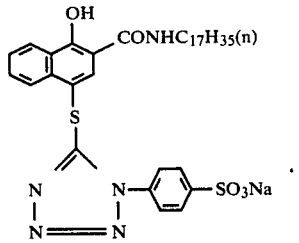
D-48
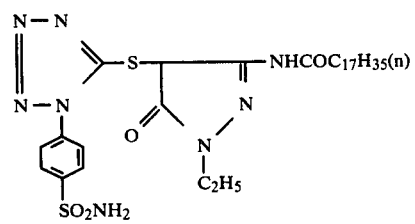
D-49
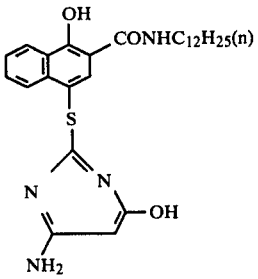
D-50
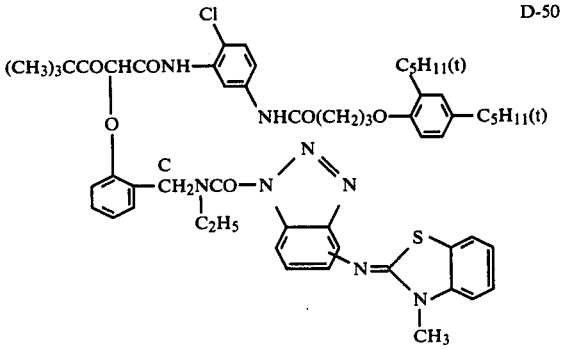
D-51
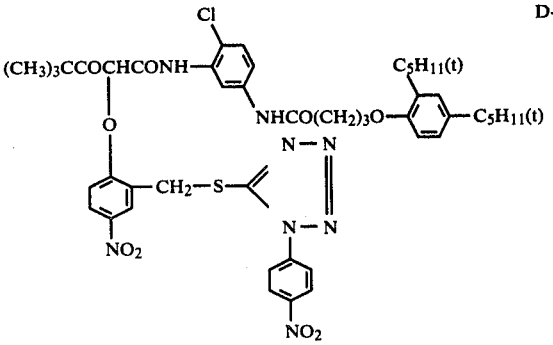
D-52
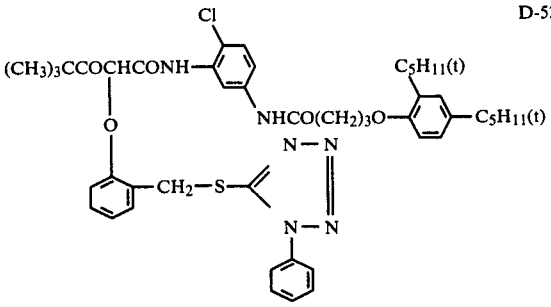
D-53
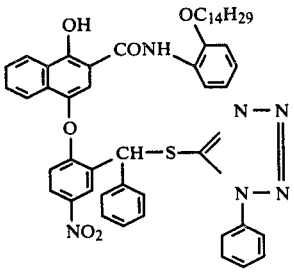

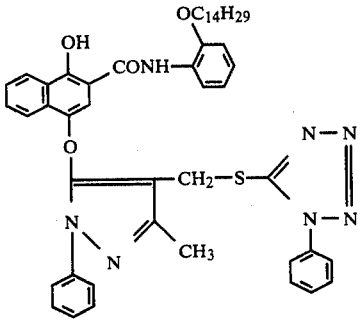

-continued

D-54

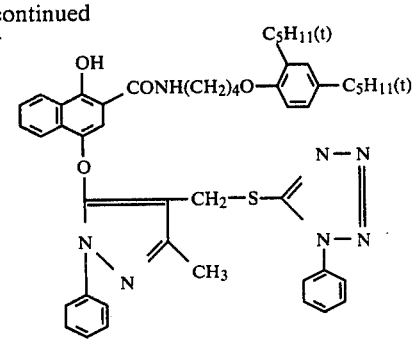

D-55

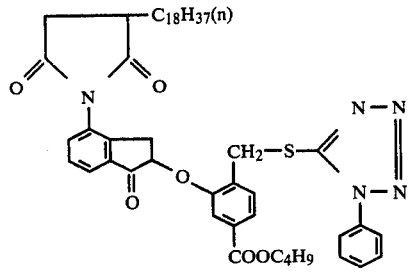

D-56

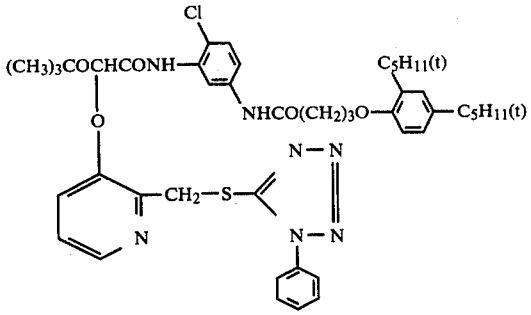

D-57

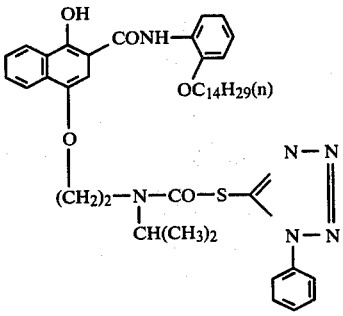

D-58

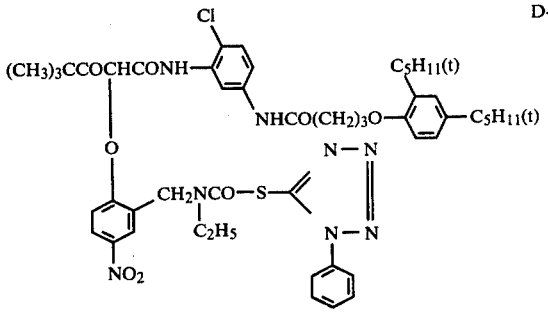

D-59

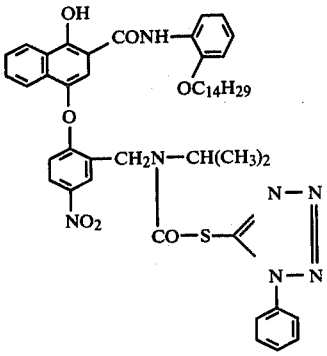

D-60

A magenta coupler and a DIR compound of the present invention may be incorporated either together in a same layer or separately in different layers of light-sensitive silver halide emulsion layer and a non-light-sensitive hydrophilic colloidal layer, but are desirable to be incorporated together in the light-sensitive silver halide emulsion layer.

In the case of incorporating into light-sensitive silver halide emulsion layers, the magenta coupler and the DIR compound of the present invention, as far as the layers are adjacent to each other, may be incorporated either together into a same emulsion layer or separately into different emulsion layers.

In order to incorporate the above coupler and the DIR compound into a silver halide emulsion layer, such a method as described in U.S. Pat. No. 2,322,027 may be used. For example, the incorporation may be made in such a manner that the coupler and the DIR compound are dissolved into a high boiling organic solvent having a boiling point of not less than 175° C. such as, e.g., dibutyl phthalate, dioctyl phthalate, triphenyl phosphate, tricresyl phosphate, phenoxyethanol, diethyleneglycol-monophenyl ether, diethoxyethyl phthalate, diethyl laurylamide, dibutyl laurylamide or the like, or into a single or a mixture of low boiling organic solvents such as ethyl acetate, butyl acetate, methanol, ethanol, butanol, acetone, β-ethoxyethyl acetate, methoxytriglycol acetate, dioxane, fluorinated alcohol and the like, and after that the solution is mixed with an aqueous gelatin solution containing a surface active agent, the mixture is then emulsified to be dispersed by means of a high-speed rotary mixer or of a colloid mill, and the dispersed liquid is directly incorporated into a silver halide emulsion layer, or alternatively, the foregoing emulsifiedly dispersed liquid is set, then cut into fine pieces and washed to remove the low boiling organic solvent therefrom, and subsequently added to a silver halide emulsion layer. If the compounds to be incorporated are alkali-soluble, the incorporation of them may be performed by the so-called Fischer dispersion method. The adding quantity of the coupler of this invention is generally preferably from $5\times10^{-3}$ to 5 moles, and more preferably from $1\times10^{-2}$ to 1.0 mole per mole of silver halide, while the adding quantity of the DIR compound of this invention is preferably from $5\times10^{-5}$ to $5\times10^{-2}$ moles, and more preferably from $1\times10^{-4}$ to $1\times10^{-2}$ moles per mole of silver halide. The silver halide color photographic light-sensitive material containing the magenta coupler of this invention may further contain such different couplers as an yellow coupler, cyan coupler and the like in combination for the formation of other dyes of an image and further a variety of photographic additives. Yellow couplers suitably usable in combination include benzoylacetanilide-type yellow couplers, pivaloylacetanilide-type yellow couplers and two-equivalent-type yellow couplers whose carbon atom at the coupling position thereof is substituted by a substituent capable of freeing therefrom during a coupling reaction. Cyan couplers suitably usable in combination include phenol derivative, naphthol derivatives and colored cyan couplers, the colored cyan couplers including compounds formed by substituting a colorless cyan coupler with an arylazo at the coupling position thereof, and colored cyan couplers of the type whose dye, as a result of the reaction thereof with the oxide of a color developing agent, dissolves out into the developing bath.

Further, in the silver halide color photographic light-sensitive material which uses the magenta coupler of the present invention there may, if necessary, be incorporated in combination another different magenta coupler such as a pyrazolone-type, pyrazolotriazole-type, pyrazolobenzimidazole-type or indazolone-type compound and a colored magenta coupler such as a compound formed by substituting a colorless magenta coupler with an arylazo at the coupling position thereof or a colored magenta coupler of the type whose dye, as a result of the reaction thereof with the oxide of a color developing agent, dissolves out into the processing both. And further, a combined use of not less than two of the magenta couplers of the present invention also enables to give an excellent silver halide color photographic light-sensitive material.

Any of the above-described couplers may, in order to satisfy the characteristics required for the light-sensitive material, be used in combination of not less than two thereof in a same layer or any same one of the couplers may be added to two or more different layers.

In the silver halide color photographic light-sensitive material applied to the present invention, those hydrophilic colloids advantageously usable for the preparation of the silver halide emulsion and also usable for the non-light-sensitive hydrophilic colloidal layer include gelatin, gelatin derivatives such as phenylcarbamylated gelatin, amylated gelatin, phthalated gelatin and the like; cellulose derivatives such as colloidal albumin, agaragar, gum arabic, hydrolyzed cellulose acetate, carboxymethyl cellulose, hydroxyethyl cellulose, methyl cellulose and the like; acrylamide imidated polyacrylamide, casein, such vinyl alcohol polymers containing urethanecarboxylic acid radical or cyanoacetyl radical as, e.g., vinyl alcohol-vinylcyanoacetate copolymer, polyvinyl alcohol, polyvinyl pyrolidone, hydrolyzed polyvinyl acetate, such polymers as obtained by the polymerization of protein or acylatedly saturated protein with a monomer having a vinyl radical; and the like. The silver halide usable in the silver halide emulsion layer includes those arbitrarily used in ordinary silver halide photographic emulsions such as silver bromide, silver chloride, silver iodobromide, silver chlorobromide, silver chloroiodobromide and the like.

The particles of these silver halides are allowed to be either of the coarse-grained type or of the fine-grained type, and the particle size distribution range of these silver halide is allowed to be either wider or narrower. The crystalline form of these silver halides may be either normal or twin, and the proportion of the [1.0.0] face to the [1.1.1] face thereof are allowed to be discretional. The structure of these silver halide particle crystals may be either uniform from the internal through the external thereof or of difference between the internal and the external thereof. Further, these silver halides may be either of the type of forming a latent image principally on the surface thereof or of the type of forming it in the inside thereof.

The silver halide emulsion for use in the silver halide color photographic light-sensitive material of this invention may be prepared not only by usually practiced methods but by such various methods as, for example, the method as described in Japanese Patent Examined Publication No. 7772/1971, the method as described in U.S. Pat. No. 2,592,250, i.e., the so-called conversion method in which an emulsion of silver halide particles at least part of which is of a silver halide whose solubility is larger than that of silver bromide is formed, and at least part of the particles is then converted to silver bromide or silver iodobromide, the method for the production of a Lippmann emulsion comprising a fine-grained silver halide having a mean particle size of not more than 0.1μ, and all other equivalent methods.

The above-described silver halide emulsion can be sensitized by chemical sensitizers. Chemical sensitizers are broadly classified into four kinds: noble metallic sensitizers, sulfur sensitizers, selenium sensitizers and reduction sensitizers.

Noble metallic sensitizers include those compounds of gold, ruthenium, rhodium, palladium, iridium, platinum and the like, and particularly preferred ones of the compounds include chloroauric acid, potassium chloroaurate, potassium aurithiocyanate, potassium chloroaurate, 2-aurosulfobenzothiazolemethyl chloride, ammonium chloropalladate, potassium chloroplatinate, sodium chloropalladite, sodium chloroiridate and the like. In addition, in the case of using gold compounds, ammonium thiocyanate or sodium thiocyanate may be used together.

Sulfur sensitizers include, in addition to active gelatin, sulfur compounds the particularly preferred compounds among which are sodium thiosulfate, ammonium thiosulfate, thiourea, thioacetamide, arylisothiourea, N-arylrhodanine and the like.

Selenium sensitizers include active and inactive selenium compounds among which the particularly preferred compounds are colloidal selenium, selenoacetophenone, selenoacetamide, selenourea, N,N-dimethylselenourea, triphenylphosphineselenide and the like.

Reduction sensitizers include stannous salts, polyamines, bisalkylaminosulfides, silane compounds, iminoaminomethanesulfinic acid, hydrazinium salts, hydrazine derivatives and the like.

Further, the silver halide emulsion may, if necessary, be highly spectrally sensitized by the single or combined use of cyanine dyes such as cyanine, merocyanine, carbocyanine and the like dyes or by the combined use thereof with styryl dye and the like.

Any selection may be made arbitrarily from such dyes according to the wavelength region to be sensitized and the sensitivity, and the like, i.e., purposes and uses of the silver halide color photographic light-sensitive material.

To the above silver halide emulsion, in order to prevent the occurrence of the deterioration of the sensitivity or of fog during the manufacturing process, storage or processing of the silver halide color photographic light-sensitive material, may be added various compounds including such heterocyclic compounds as 1-phenyl-5-mercaptotetrazole, 3-methylbenzothiazole, 4-hydroxy-6-methyl-1,3,3a,7-tetrazaindene, etc., mercapto compounds, metallic salts and the like.

The hardening of the emulsion may be practiced in normal manners. Hardeners usable for this purpose include normally applied photographic hardeners, e.g., aldehyde-type compounds such as formaldehyde, glyoxal, glutaraldehyde, etc., and acetals thereof or derivatives such as sodium hydrogensulfite adducts thereof, methanesulfonic acid ester-type compounds, mucochloric acid- or mucohalogenic acid-type compounds, epoxy-type compounds, aziridine-type compounds, active halogen-type compounds, maleic acid imide-type compounds, active vinyl-type compounds, carbonimide-type compounds, isooxazole-type compounds, N-methylol-type compounds, isocyanate-type compounds, or such inorganic hardeners as chrome alum, zirconium sulfate and the like.

To the above silver halide emulsion may be added a single surface active agent or a mixture of different surface active agents. As the surface active agent there may be used various active agents, intended to be used as a coating aid, emulsifying agent, agent for improving the permeability into a processing liquid or the like, defoaming agent, antistatic agent or antiadhesion agent, or as an element for the improvement of photographic characteristics or for the control of physical properties, such a natural matter as saponin, nonionic surface active agents such as alkyleneoxide-type, glycerol-type, glycidol-type compounds, etc.; cationic surface active agents such as higher alkylamines, heterocyclic compounds such as pyridine, quaternary nitrogen-onium salts, phosphoniums, sulfoniums, etc.; anionic surface active agents such as carboxylic acid, sulfonic acid, phosphoric acid, anionic surface active agents containing such an acid radicals as sulfuric acid ester radical, phosphoric acid ester radical, etc.; amphoteric surface active agents such as amino acids, aminosulfonic acids, etc.; and the like.

The silver halide color photographic light-sensitive material of the present invention is allowed to contain in the component layers (e.g., a protective layer, interlayers, emulsion layers, a backing layer, etc.) thereof, as an ultraviolet absorbing agent, benzotriazoles, triazines, benzophenone compounds or acrylonitrile-type compounds.

Further, for the purpose of increasing the stability of a color photographic image, into the emulsion layers and/or the non-light-sensitive hydrophilic colloidal layer adjacent thereto of the silver halide color photographic light-sensitive material of the present invention may be incorporated p-substituted phenols. The particularly preferred p-substituted phenols are alkyl-substituted hydroquinones, bishydroquinones, polymer-type hydroquinones, p-alkoxyphenols, phenolic compounds and the like. In addition, alkoxy- or amyloxy-derivatives of 6-chromanol or 6,6'-dihydroxy-2,2'-spirochroman may also be used likewise.

The silver halide color photographic light-sensitive material of the present invention is produced by coating on a support which has an excellent flatness and whose dimensions little change during processing. Examples of the materials usable for the support include such films as of cellulose acetate, cellulose nitrate, polyvinyl acetal, polypropylene, polyethylene terephthalate, polyamide, polycarbonate, polystyrene and the like, polyethylene-laminated paper, polypropylene synthetic paper, baryta paper and the like. An arbitrary selection for the support from among these materials may be made according to uses of the silver halide color photographic light-sensitive material.

These supports are generally coated thereon with a subbing layer. Typical subbing materials for use in the sub-coating include copolymers of vinyl chloride or vinylidene chloride, copolymers of esters of vinyl alcohols, unsaturated carboxylic acid-containing copolymers, copolymers of dienes such as butadiene, copolymers of acetals, copolymers of unsaturated carboxylic acid anhydrides such as maleic anhydride, particularly, copolymers thereof with such a vinyl alcohol ester as vinyl acetate, etc., or with styrene, or open-ring compounds thereof by water, alkalis, alcohols or amines, such cellulose derivatives as nitrocellulose, diacetylcellulose, etc., epoxy radical-containing compounds, gelatin or gelatin-modified compounds, polyolefin copolymers and the like.

Further, gelatin or polyols, monohydric or polyhydric phenol or the halogen-substituted compounds thereof, cross-linking agents (hardeners), metallic oxides or the like may be used together with the foregoing subbing materials for subbing the support.

In the actual process for subbing the support, the above subbing materials may be used singly or in combination. The subbing layer may be comprised of a single layer or of double layers, but of course be further coated thereon with another layer with use of a subbing material; for example, a vinylidene chloride copolymer layer is coated thereon further with a gelatin layer, or multilayer coatings of subbing layers are made by coating a vinylidene chloride copolymer layer, a layer of a mixture of gelatin with vinylidene chloride copolymer, and a gelatin layer in this order; thus an arbitrarily combined use of such materials may be allowed according to purposes, and multilayer coatings in such an arbitrarily combined use may also be performed.

Aside from the above-mentioned subbing treatments by use of such subbing materials, the adhesion of an emulsion layer to the support may also be practiced by subjecting the surface of the support to such a treatment as a corona-discharge treatment, glow-discharge treatment or other electronic impact treatment, flame treatment, ultraviolet illumination, oxidizing treatment, saponification treatment, matting treatment or the like. These treatments may be used singly or in combination, but a combined use of any of such treatments with any of the foregoing subbing materials enables to provide a sufficient subbing effect for the support.

The silver halide color photographic light-sensitive materials of the present invention include all kinds of silver halide color photographic light-sensitive material such as color negative film, color positive film, color reversal film, color photographic paper and the like.

Color developing agents for use in the present invention are aromatic primary amine compounds among which those particularly preferred are p-phenylenediamine-type developing agents such as, for example, 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, 3-β-methanesulfonamidoethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-4-methyl-4-aminoaniline and such salts of these compounds as sulfates, hydrochlorides, sulfites, p-toluenesulfonates, and the like.

Photographic additives intended for use with these color developing agents for a color developer liquid are alkali agents (such as, e.g., hydroxides, carbonates, phosphates, etc., of alkali metals or of ammonium), pH adjusting agents or buffers (e.g., such weak acids as acetic acid, boric acid, etc., or weak bases and salts thereof), development accelerators (such as, e.g., a pyridium compound, a cationic compound, potassium nitrate, sodium nitrate, polyethylene glycol condensates and derivatives thereof, nonionic compounds such as polythioethers, sulfite ester-having polymer compounds and, in addition, pyridine, ethanolamines, organic amines, benzylalcohol, hydrazines, etc.), antifoggants (such as alkali bromides, alkali iodides, nitrobenzimidazoles, mercaptobenzimidazole, 5-methylbenzotriazole, 1-phenyl-5-mercaptotetrazole, compounds for rapid processing use, nitrobenzoic acid, benzothiazolium derivatives, phenazine-N-oxides, etc.), antistain or antisludge agents, multilayer effect accelerators, preservatives (such as, e.g., sulfites, hydrogensulfites, hydroxylamine hydrochloride, formsulfite, alkanolaminesulfite adducts, etc.), and the like.

The silver halide color photographic light-sensitive material that has been processed in a color developer liquid containing such agents as mentioned above may, after the development, be subjected to arbitrarily combined processings selected from the group of the processings in a stop solution containing an organic acid as used in ordinary photographic processings; a stop fixer containing such fixing components as an organic acid and hypo or ammonium thiosulfate, etc.; a fixer containing such a fixing component as hypo or ammonium thiosulfate, etc.; a bleaching bath containing, as principal components, ferric salt of aminopolycarboxylic acid and an alkali halide; bleach-fixing bath containing ferric salt of aminocarboxylic acid and such a fixing component as ammonium thiosulfate or hypo; the processing in such a processing liquid as a stabilizer, washing in water and drying.

The present invention will be further illustrated by the following examples, but it is to be understood that the embodiment of the invention is not limited thereto.

EXAMPLE 1

Sample-1 of the present invention was prepared in the following manner:

[Sample-1]

Twenty grams of Exemplified Coupler M-18 and 1.0 g of Exemplified DIR Compound D-42 were added to a mixture liquid of 10 ml of tricresyl phosphate with 50 ml of ethyl acetate, and the resulting mixture was heated to 60° C. to be completely dissolved. This solution was mixed with 20 ml of an aqueous 10% Alkanol B (alkylnaphthalenesulfonate, a product of DuPont) solution and 100 ml of an aqueous 10% gelatin solution, and the mixture was emulsified to be dispersed by means of a colloid mill. The dispersed liquid was then added to 1 mole of a silver iodobromide emulsion containing 6 mole% of silver iodide, to which were further added 4-hydroxy-6-methyl-1,3,3a,7-tetrazaindene, saponin and a hardener 1,2-bis-(vinyl-sulfonyl) ethane, and the resulting liquid was coated on a triacetate film base and then dried, thereby preparing Sample-1.

Subsequently, Samples-2 to -16 were prepared in quite the same manner as in Sample-1 with the exception that in place of the Exemplified Coupler M-18 and the Exemplified DIR Compound D-42 used in Sample-1, the exemplified couplers and the exemplified DIR compounds that are indicated in Table 1 and the following Comparative Couplers (1) to (3) and Comparative DIR Compounds (1) and (2) were used.

Comparative Coupler (1)

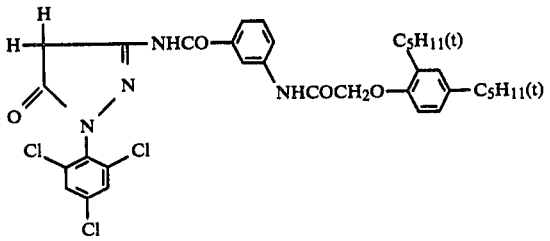

Comparative Coupler (2)

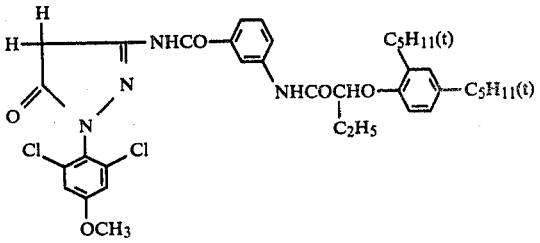

Comparative Coupler (3)

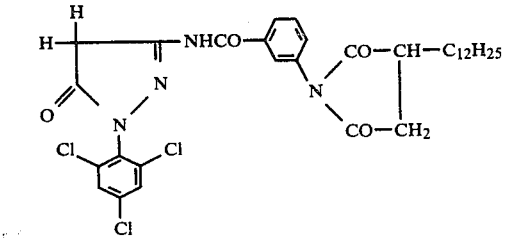

-continued

Comparative DIR Compound (1)

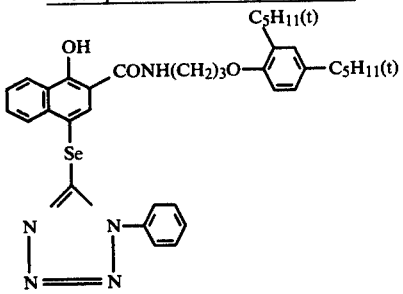

Comparative DIR Compound (2)

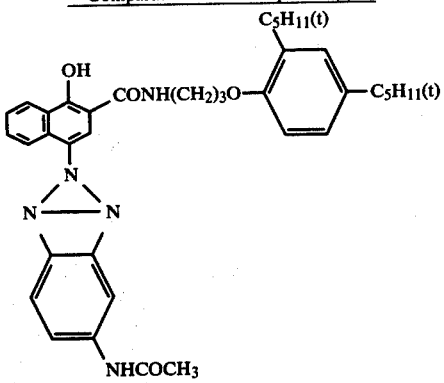

Each of the thus obtained samples was exposed through an optical wedge to light and then processed in the following developing processes. The results obtained for the respective samples are as shown in Table 1. In addition, the values shown in the columns "ΔFog ①" and "ΔFog ②" under the "Change in processing fog" in Table 1 are the values of increase in fog of the samples when processed in the color developer with its pH adjusted at 10.2 and kept at a temperature of 40° C. The values shown in the column "Relative speed" in the table are the relative values of the respective samples to the speed regarded as 100 of the samples (Sample-12 and Sample-14) prepared by the use of Comparative Coupler (1) and Comparative Coupler (2), respectively.

| Developing Processed (38° C.) | Processing Time |
|---|---|
| Color development | 3 min. and 15 sec. |
| Bleaching | 6 min. and 30 sec. |
| Washing | 3 min. and 15 sec. |
| Fixing | 6 min. and 30 sec. |
| Washing | 3 min. and 15 sec. |
| Stabilizing | 1 min. and 30 sec. |

The respective compositions of the processing liquids used in the above-mentioned processes are as follows:

| | |
|---|---|
| Color Developer: | |
| 4-amino-3-methyl-N—ethyl-N—(β-hydroxyethyl)-aniline sulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water to make 1 liter | |
| pH adjusted at 10.0 by use of potassium hydroxide | |
| Bleaching Bath: | |
| Iron ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| Water to make 1 liter | |
| pH adjusted at 6.0 by use of aqueous ammonia | |
| Fixer: | |
| Ammonium thiosulfate (aqueous 50% solution) | 162.0 ml |
| Anhydrous sodium sulfite | 12.4 g |
| Water to make 1 liter | |
| pH adjusted at 6.5 by use of acetic acid | |
| Stabilizing bath: | |
| Formalin (aqueous 37% solution) | 5.0 ml |
| Koniducks (product of Konishiroku Photo Industry Co., Ltd.) | 7.5 ml |
| Water to make 1 liter | |

The samples were processed under the above conditions.

TABLE 1

| Sample No. | Magenta coupler | DIR compound | Relative speed | Maximum density | Change in processing fog Δ Fog ① | Δ Fog ② |
|---|---|---|---|---|---|---|
| 1 | Exemplified coupler M-18 | Exemplified DIR D-2 | 105 | 1.9 | 0.04 | 0.04 |
| 2 | Exemplified coupler M-18 | Exemplified DIR D-33 | 100 | 1.9 | 0.05 | 0.03 |
| 3 | Exemplified coupler M-18 | Exemplified DIR D-42 | 105 | 1.9 | 0.04 | 0.03 |
| 4 | Exemplified coupler M-18 | Comparative DIR (1) | 100 | 1.9 | 0.08 | 0.06 |
| 5 | Exemplified coupler M-18 | Comparative DIR (2) | 100 | 1.9 | 0.08 | 0.06 |
| 6 | Exemplified coupler M-18 | None | 125 | 2.4 | 0.08 | 0.06 |
| 7 | Exemplified coupler M-14 | Exemplified DIR D-42 | 100 | 1.8 | 0.05 | 0.03 |
| 8 | Exemplified coupler M-14 | None | 120 | 2.2 | 0.09 | 0.06 |
| 9 | Exemplified coupler M-16 | Exemplified DIR D-2 | 95 | 1.8 | 0.05 | 0.04 |
| 10 | Exemplified coupler M-16 | None | 120 | 2.2 | 0.09 | 0.07 |
| 11 | Comparative coupler (1) | Exemplified DIR D-42 | 80 | 1.6 | 0.04 | 0.03 |
| 12 | Comparative | None | 100 | 2.0 | 0.04 | 0.03 |

TABLE 1-continued

| Sample No. | Magenta coupler | DIR compound | Relative speed | Maximum density | Change in processing fog Δ Fog 1 | Δ Fog 2 |
|---|---|---|---|---|---|---|
| | coupler (1) | | | | | |
| 13 | Comparative coupler (2) | Exemplified DIR D-42 | 80 | 1.5 | 0.04 | 0.04 |
| 14 | Comparative coupler (2) | None | 100 | 1.8 | 0.04 | 0.04 |
| 15 | Comparative coupler (3) | Exemplified DIR D-42 | 75 | 1.6 | 0.05 | 0.03 |
| 16 | Comparative coupler (3) | None | 95 | 1.9 | 0.05 | 0.03 |

It is apparent from Table 1 that the samples of Exemplified Couplers M-18, M-14 and M-16 have high relative speeds as well as high maximum densities as compared to those of the samples of Comparative Couplers (1), (2) and (3). However, the samples containing Exemplified Couplers but free of Exemplified DIR compounds have higher Fog values, i.e., they have larger change in the processing fog, whereas the samples of Exemplified Couplers M-18, M-14 and M-16 with DIR compounds have as small Fog values as on the level of Comparative Couplers. However, in the examples where Exemplified Coupler M-18 is used, the ones containing Comparative DIR Compounds show no decrease in Fog values.

And in the samples of Comparative Couplers (1), (2) and (3), the ones containing Exemplified DIR Compounds D-42 show no change in Fog values. Thus, the magenta couplers of the present invention are understood to be excellent in the color developability as well as to have no problem of change in the processing fog in the case where the DIR compounds of the present invention are used together. In addition, it has been found that Sample-1 is excellently stable with time, and Sample-2 and Sample-3 have small fog values even under normal processing conditions.

EXAMPLE 2

A transparent cellulose triacetate film support was coated thereon with the following layers in the order described from the support side to thereby obtain multilayered color negative light-sensitive materials (Sample-17 and Sample-18) containing in the green-sensitive layers thereof the compounds of this invention given in Table 2.

First layer: Antihalation Layer

An aqueous gelatin solution containing black colloidal silver was coated so that the coated quantity of the silver is 0.3 g/m$^2$ and in the dried thickness of 30μ.

Second Layer: Interlayer

An aqueous gelatin solution was coated so as to be in the dry thickness of 1.0μ.

Third Layer: Red-Sensitive, Low-Speed Silver Halide Emulsion Layer

A silver iodobromide emulsion (prepared by mixing 2 parts of a silver iodobromide emulsion having a mean particle size of 0.6μ and containing 4 mole% of silver iodide with one part of a silver iodobromide emulsion having a mean particle size of 0.3μ and containing 4 mole% of silver iodide) was chemically sensitized by the use of a gold sensitizer and a sulfur sensitizer, and to this were then added, as red-sensitive sensitizing dyes, anhydrous 9-ethyl-3,3'-di-(3-sulfopropyl)-4,5,4',5'-dibenzothiacarbocyaninehydroxide, anhydrous 5,5'-dichloro-9-ethyl-3,3'-di-(3-sulfobutyl)thiacarbocyaninehydroxide and anhydrous 2-[2-{(5-chloro-3-ethyl-2(3H)-benzothiazolidene)methyl}-1-butenyl-5-chloro-3-(4-sulfobutyl)benzoxozolium, and after that further added 1.0 g of 4-hydroxy-6-methyl-1,3,3a,7-tetrazaindene and 20.0 ml of 1-phenyl-5-mercaptotetrazole to thereby prepare a red-sensitive, low-speed emulsion. Further to this emulsion were added, per mole of silver halide, 59 g of a cyan coupler 1-hydroxy-N-[δ-(2,4-di-t-amylphenoxy)butyl]-2-naphthoamide, 4 g of a colored cyan coupler disodium 1-hydroxy-4-[4-(1-hydroxy-8-acetamido-3,6-disulfo-2-naphthylazo)phenoxy]-N-[δ-(2,4-di-t-amylphenoxy)butyl]-2-naphthoamide, 1.7 g of a DIR compound 2-(1-phenyl-5-tetrazolylthio)-4-octadecyl-succinimido-1-indanone and 0.5 g of dodecyl gallate. To this was further added a dispersed liquid prepared in the manner that a mixture of 65 g of tricresyl phosphate and 136 ml of ethyl acetate is dissolved by heating, this solution is added to 550 ml of an aqueous 7.5% gelatin solution containing 5 g of sodium triisopropylnaphthalenesulfate, and the mixture is then emulsified to be dispersed by means a colloid mill, whereby an objective red-sensitive, low-speed emulsion was obtained. The thus obtained emulsion was coated so as to be in the dry thickness of 4.0μ (containing 160 g of gelatin per mole of silver halide).

Fourth Layer: Red-Sensitive, High-Speed Silver Halide Emulsion Layer

A silver iodobromide emulsion (with a mean particle size of 1.2μ containing 7 mole% of silver iodide) was chemically sensitized by a gold sensitizer and a sulfur sensitizer. To this emulsion were added, as red-sensitive sensitizing dyes, anhydrous 9-ethyl-3,3'-di-(3-sulfopropyl)-4,5,4',5'-dibenzothiacarbocyaninehydroxide, anhydrous 5,5'-dichloro-9-ethyl-3,3'-di-(3-sulfobutyl)-thiacarbocyaninehydroxide and anhydrous 2-[2-{(5-chloro-3-ethyl-2(3H)-benzothiazolidene)methyl}-1-butenyl-5-chloro-3-(4-sulfobutyl)benzoxazolium, and after that further added 1.0 g of 4-hydroxy-6-methyl-1,3,3a,7-tetrazaindene and 10.0 mg of 1-phenyl-5-mercaptotetrazole to thereby prepare a red-sensitive, high-speed emulsion. Further to this emulsion were added, per mole of silver, 17 g of a cyan coupler 1-hydroxy-N-[δ-(2,4-di-t-amylphenoxy)butyl]-2-naphthoamide, 4 g of a colored cyan coupler disodium 1-hydroxy-4-[4-(1-hydroxy-8-acetamido-3,6-disulfo-2-naphthylazo)-phenoxy]-N-[δ-(2,4-di-t-amylphenoxy)butyl]-2-naphthoamide, 1.6 g of a DIR compound 2-(1-phenyl-5-tetrazolylthio)-4-octadecylsuccinimido-1-indanone and 0.5 g of dodecyl gallate. To this were further added a dispersed liquid prepared in the manner that a mixture of 20 g of tricresyl phosphate and 60 ml of ethyl acetate is dissolved by heating, this solution is added to 30 ml of an aqueous 7.5% gelatin solution containing 1.5 g of sodium triisopropylnaphthalenesulfonate, and the mixture is emulsified to be dispersed by means of a colloid mill, whereby an objective red-sensitive, high-speed emulsion was obtained. The thus obtained emulsion was coated so as to be in the dry thickness of 2.0μ (containing 160 g of gelatin per mole of silver halide).

Fifth Layer: Interlayer

The same as the second layer.

Sixth Layer: Green-Sensitive, Low-speed Silver Halide Emulsion Layer

A silver iodobromide emulsion with a mean particle size of 0.6μ containing 4 mole% of silver iodide and a silver iodobromide emulsion with a mean particle size of 0.3μ containing 7 mole% of silver iodide were separately chemically sensitized by a gold sensitizer and a sulfur sensitizer. To the respective emulsions were added separately, as green-sensitive sensitizing dyes, anhydrous 5,5'-dichloro-9-ethyl-3,3'-di-(3-sulfobutyl-)oxacarbocyaninehydroxide, anhydrous 5,5'-diphenyl-9-ethyl-3,3'-di-(3-sulfobutyl)oxacarbocyaninehydroxide and anhydrous 9-ethyl-3,3'-di-(3-sulfopropyl)-5,6,5',6'-dibenzoxacarbocyaninehydroxide, and subsequently further added 1.0 g of 4-hydroxy-6-methyl-1,3,3a,7-tetrazaindene and 20.0 mg of 1-phenyl-5-mercaptotetrazole, thereby preparing in usual manner. The thus obtained two silver halide emulsions were mixed in the proportion of 1:1, whereby a green-sensitive, low-speed silver halide emulsion was prepared.

Further to the resulting silver halide emulsion were added, per mole of silver halide, 2.5 g of a colored magenta coupler 1-(2,4,6-trichlorophenyl)-4-(1-naphthylazo)-3-(2-chloro-5-octadecenylsuccinimidoanilino)-5-pyrazolone and 0.5 g of dodecyl gallate, and subsequently added the magenta coupler and the DIR coupler which are given in Table 2. On the other hand a mixture of 120 g of tricresyl phosphate and 240 ml of ethyl acetate was dissolved by heating, the solution was added to an aqueous gelatin solution containing sodium triisopropylnaphthalenesulfonate, and the mixture was emulsified to be dispersed by means of a colloid mill to thereby prepare a dispersed liquid. This dispersed liquid was added to the foregoing emulsion to thereby prepare an objective green-sensitive, low-speed emulsion, which was then coated so as to be in the dry thickness of 4.0μ (containing 160 g of gelatin per mole of silver halide).

Seventh Layer: Green-sensitive, High-Speed Silver Halide Emulsion Layer

A silver iodobromide emulsion (with a mean particle size of 1.2μ containing 7 mole% of silver iodide) was chemically sensitized by a gold sensitizer and a sulfur sensitizer. To this emulsion were added, as green-sensitive sensitizing dyes, anhydrous 5,5'-dichloro-9-ethyl-3,3'-di-(3-sulfobutyl)oxacarbocyaninehydroxide, anhydrous 5,5'-diphenyl-9-ethyl-3,3'-di-(3-sulfobutyl)oxacarbocyaninehydroxide and anhydrous 9-ethyl-3,3'-di-(3-sulfopropyl)-5,6,5',6'-dibenzoxacarbocyaninehydroxide, and further added 1.0 g of 4-hydroxy-6-methyl-1,3,3a,7-tetrazaindene and 10.0 mg of 1-phenyl-5-mercaptotetrazole to thereby a green-sensitive, high-speed silver halide emulsion. Further to this emulsion were added, per mole of silver halide, 2.5 g of a colored magenta coupler 1-(2,4,6-trichlorophenyl)-4-(1-naphthylazo)-3-(2-chloro-5-octadecenylsuccinimidoanilino)-5-pyrazolone, 1.5 g of 2,5-di-t-octylhydroquinone, and the magenta coupler and the DIR compound that are given in Table 2. On the other hand, a mixture of 120 g of tricresyl phosphate and 240 ml of ethyl acetate was dissolved by heating, the solution was added to an aqueous gelatin solution containing sodium triisopropylnaphthalenesulfonate and the mixture was emulsified to be dispersed by means of a colloid mill to thereby prepare a dispersed liquid. This dispersed liquid was added to the foregoing emulsion to thereby prepare an objective green-sensitive, high-speed emulsion, which was then coated so as to be in the dry thickness of 2.0μ (containing 160 g of gelatin per mole of silver halide).

Eighth Layer: Interlayer

The same as the second layer.

Ninth Layer: Yellow Filter Layer

To an yellow colloidal silver-dispersed aqueous gelatin solution was added a dispersed liquid prepared in the manner that 3 g of 2,5-di-t-octylhydroquinone and 1.5 g of di-2-ethylhexylphthalate are dissolved into 10 ml of ethyl acetate and this solution is dispersed into an aqueous gelatin solution containing 0.3 g of sodium triisopropylnaphthalenesulfonate. This was then coated so that the coating quantity of the gelatin is 0.9 g/m$^2$ and that of the 2,5-di-t-octylhydroquinone is 0.10 g/m$^2$ with the dry thickness of 1.2μ.

Tenth Layer: Blue-Sensitive, Low-Speed Silver Halide Emulsion Layer

A silver iodobromide emulsion (with a mean particle size of 0.6μ containing 6 mole% of silver iodide) was chemically sensitized by use of a gold sensitizer and a sulfur sensitizer. To this emulsion were added, as a sensitizing dye, anhydrous 5,5'-dimethoxy-3,3'-di-(3-sulfopropyl)thiacyaninehydroxide and further added 1.0 g of 4-hydroxy-6-methyl-1,3,3a,7-tetrazaindene and 20.0 mg of 1-phenyl-5-mercaptotetrazole, thereby preparing a blue-sensitive, low-speed silver halide emulsion in usual manner. Further to this emulsion were added, per mole of silver halide, as yellow couplers, 120 g of 60 -pivaloyl-α-(1-benzyl-2-phenyl-3,5-dioxo-1,2,4-triazolidine-4-yl)-2'-chloro-5'-[α-(dodecyloxycarbonyl)ethoxycarbonyl]acetanilide and 50 g of α-{3-[α-(2,4-di-t-amylphenoxyl)butylamido]}benzoyl-2'-methoxyacetanilide. On the other hand, a mixture of 120 g of butyl phthalate and 300 ml of ethyl acetate was dissolved by heating, this was added to an aqueous gelatin solution containing sodium triisopropylnaphthalenesulfonate and the mixture was emulsified to be dispersed by means of a colloid mill to thereby prepare a dispersed liquid. This dispersed liquid was then added to the above-prepared emulsion to thereby prepare an objective blue-sensitive, low-speed silver halide emulsion, which was coated so as to be in the dry thickness of 4.0μ (containing 160 g of gelatin per mole of silver halide).

Eleventh Layer: Blue-Sensitive, High-Speed Silver Halide Emulsion Layer

A silver iodobromide emulsion (with a mean particle size of 1.2μ containing 7 mole% of silver iodide) was chemically sensitized by use of a gold sensitizer and a sulfur sensitizer. To this emulsion were added a sensitizing dye anhydrous 5,5'-dimethoxy-3,3'-(3-sulfopropyl)-thiacyaninehydroxide, 1.0 g of 4-hydroxy-6-methyl- 1,3,3a,7-tetrazaindene and 10.0 mg of 1-phenyl-5-mercaptotetrazole, thereby preparing a blue-sensitive, high-speed silver halide emulsion in normal manner. To this were further added, per mole of silver halide, 80 g of an yellow coupler α-pivaloyl-α-(1-benzyl-2-phenyl-3,5-dioxo-1,2,4-triazolidine-4-yl)-2'-chloro-5'-[α-dodecyloxycarbonyl)ethoxycarbonyl]acetanilide. On the other hand, a mixture of 80 g of dibutyl phthalate and 240 ml of ethyl acetate was dissolved by heating, this was added to an aqueous gelatin solution containing sodium triisopropylnaphthalenesulfonate and the mixture was emulsified to be dispersed by means of a colloid mill to thereby prepare a dispersed liquid. This dispersed liquid was added to the above prepared emulsion to thereby prepare an objective blue-sensitive, high-speed silver halide emulsion, which was then coated so as to be in the dry thickness of 2.0μ (containing 240 g of gelatin per mole of silver halide).

Twelfth Layer: Inter layer

Two grams of di-2-ethylhexyl phthalate, 2 g of 2-[3-cyano-3-(n-dodecylaminocarbonyl)allylidene]-1-ethylpyrrolidine and 2 ml of ethyl acetate were mixed, and the mixture was added into an aqueous gelatin solution containing sodium triisopropylnaphthalenesulfonate to obtain a dispersed liquid. The thus prepared liquid was coated so that the coating quantity of the gelatin is 1.0 g/m$^2$ with the dry thickness of 1.0μ.

Thirteenth Layer: Protective Layer

An aqueous gelatin solution containing, per 100 ml, 4 g of gelatin and 0.2 g of 1,2-bisvinylsulfonylethane was coated so that the coating quantity of the gelatin is 1.3 g/m$^2$ with the dry thickness of 1.2μ.

TABLE 2

| Layer | Additives | Sample-17 | Sample-18 |
|---|---|---|---|
| Sixth layer | Coupler | Comparative Coupler (1) (5.0 g/Agx) | Exemplified Coupler M-18 (5.0 g/Agx) |
| | DIR compound | Exemplified DIR Compound D-42 (0.2 g/Agx) | Exemplified DIR Compound D-42 (0.2 g/Agx) |
| Seventh layer | Coupler | Comparative Coupler (1) (10.0 g/Agx) | Exemplified Coupler M-18 |
| | DIR compound | Exemplified DIR Compound D-42 (0.5 g/Agx) | Exemplified DIR Compound D-42 (0.5 g/Agx) |

These high-speed multi-layered color negative light-sensitive materials (multi-layered Samples-17 and -18) were exposed through an optical wedge to light and then processed in the same manner as in Example 1. The obtained results are as given in Table 3. The values of ΔFog ① and ΔFog ② under the "Change in processing fog" in the table are as defined in Example 1.

TABLE 3

| Multi-layered sample No. | Relative speed | Change in processing fog | |
|---|---|---|---|
| | | Fog ① | Fog ② |
| 17 | 100 | 0.04 | 0.03 |
| 18 | 120 | 0.04 | 0.03 |

As apparent from Table 3, Sample-18 has a high relative speed as compared to Sample-17, and yet is equal in the "Change in processing fog" to Sample-17.

What is claimed is:

1. A silver halide color photographic light-sensitive material comprising a support and at least two coating layers thereon, at least one of said coating layers is a light sensitive silver halide emulsion layer, at least one of said coating layers is a non-light-sensitive hydrophilic colloidal layer, and at least one of said coating layers comprises at least one magenta coupler of Formula I and at least one development inhibitor releasing compound having a development inhibitor radical of Formulas II or III, said Formula I being

I

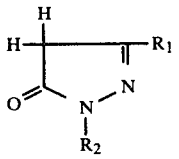

wherein $R_1$ is selected from benzamido, anilino, and phenylureido, each having a sulfonamido group and $R_2$ is selected from aryl and heterocyclic groups; said Formula II being

II

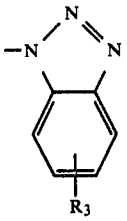

wherein $R_3$ is selected from hydrogen, halogen, acylamino, alkyl, benzothiazolinylidenamino and phenyl substituted alkoxy; said Formula III being

III

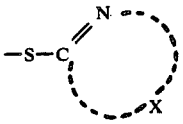

wherein X is a group of non-metallic atoms necessary to complete, together with the C=N group, a five or six membered heterocyclic ring.

2. The material of claim 1 wherein said $R_1$ is selected from

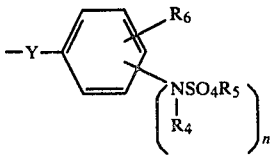

and

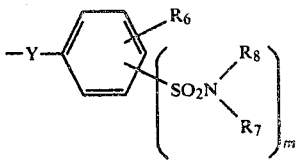

wherein Y is selected from —NH—, —NHCOHN—, and —NHCO—, the N thereof being bound to the pyrazolone group; $R_4$, $R_7$, and $R_8$ are independently selected from H, alkyl, aryl, and heterocyclic; $R_5$ is selected from alkyl, aryl, alkoxy, and amino, $R_6$ is selected from H, halogen, and alkoxy; and n and m are independently integers of 1 or 2.

3. A light-sensitive material according to claim 1, wherein $R_3$ in Formula [II] is a halogen atom, an acylamino radical or a benzothiazolinylidenamino radical having the formula:

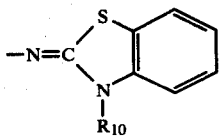

wherein $R_{10}$ is an aryl radical or an alkyl radical having from 1 to 4 carbon atoms.

4. The material of claim 1 wherein said development inhibitor radical is

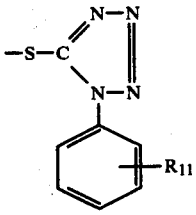

wherein $R_{11}$ is selected from halogen, $-NO_2$, alkyl, alkoxy, amino, acylamino, hydroxy, sulfo and sulfamoyl radicals.

5. The material of claim 1 wherein $R_2$ is a phenyl group having at least one ortho position substituted with alkyl, alkoxy, or halogen.

6. The material of claim 1 wherein said development inhibitor releasing compound releases a development inhibitor selected from

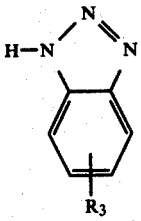

and

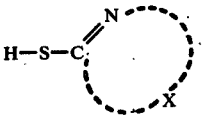

7. The material of claim 1 wherein $R_2$ is selected from phenyl, napthyl, pyridyl, quinolyl, furyl, benzothiazolyl, oxazolyl, imidazolyl, and naphthooxazolyl.

8. The material of claim 1 wherein said magenta coupler is selected from

M - 1

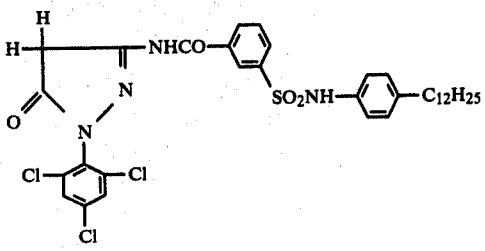

-continued

M - 2

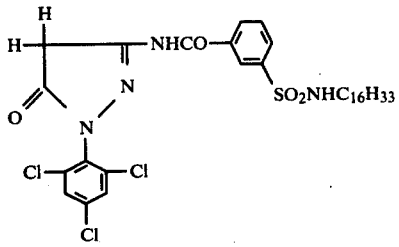

M - 3

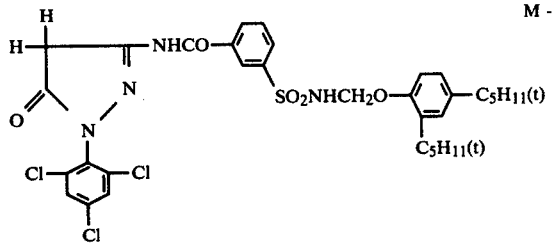

M - 4

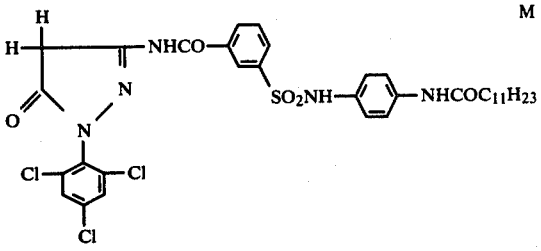

M - 5

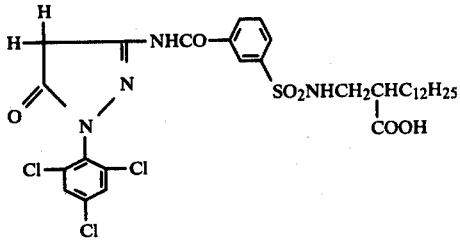

M - 6

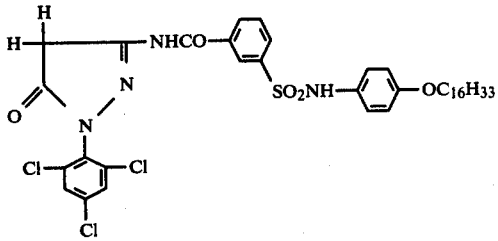

M - 7

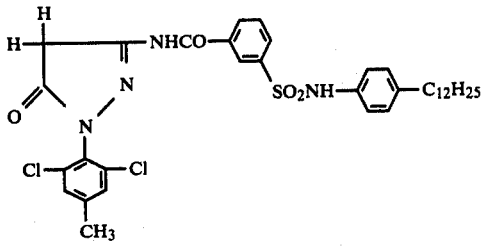

-continued
M - 8
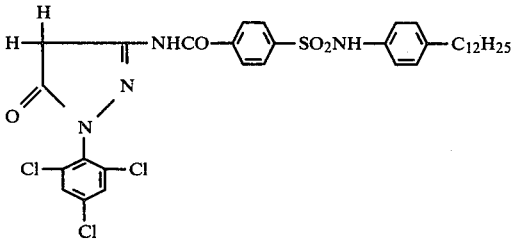
M - 9
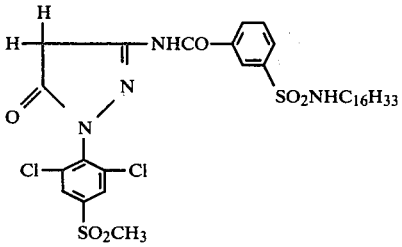
M - 10
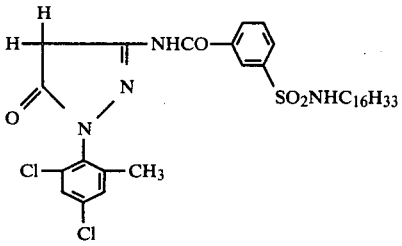
M - 11
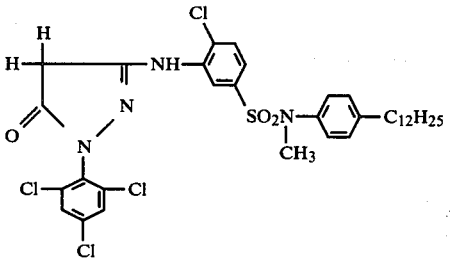
M - 12
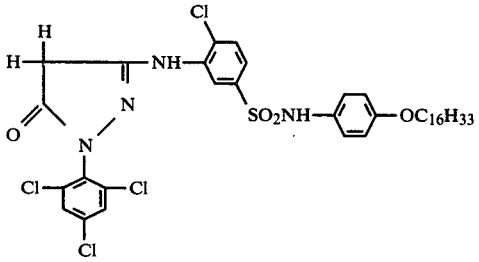
M - 13
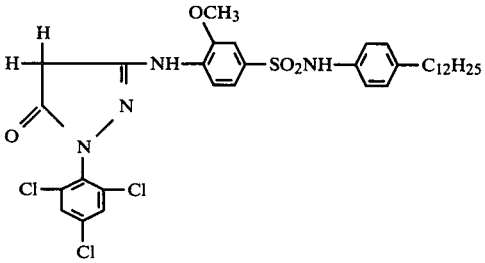
-continued
M - 14
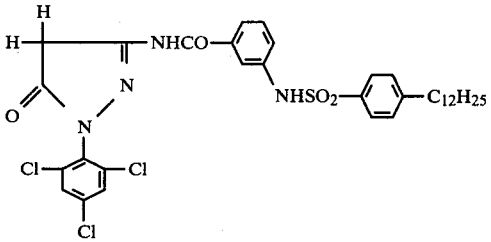
M - 15
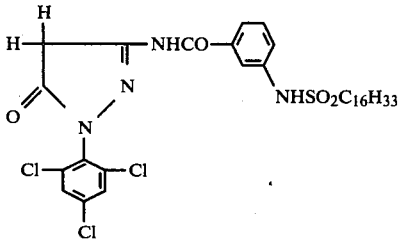
M - 16
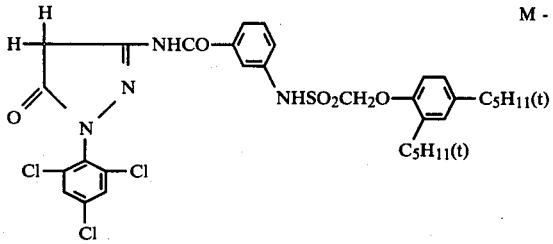
M - 17
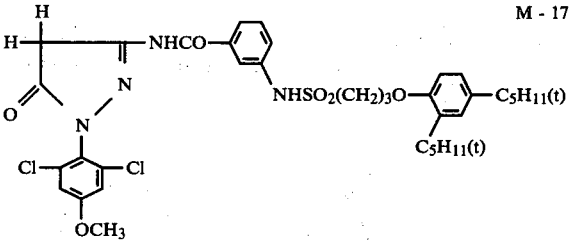
M - 18
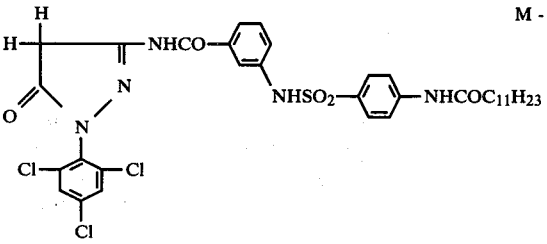
M - 19
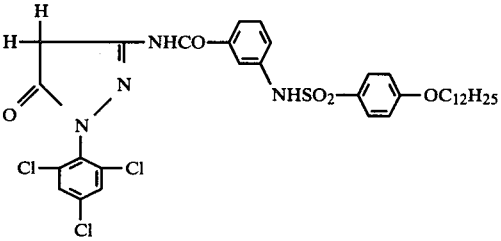

-continued
M - 20
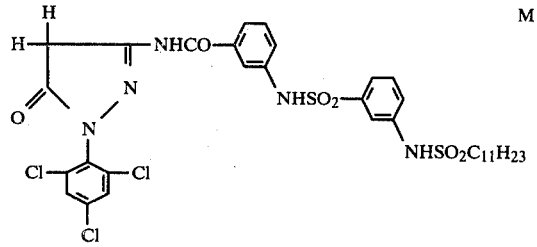
M - 21
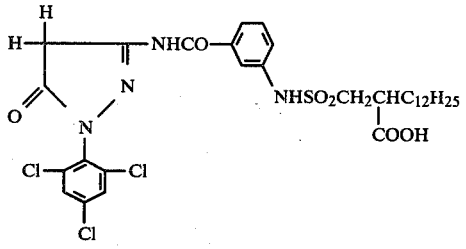
M - 22
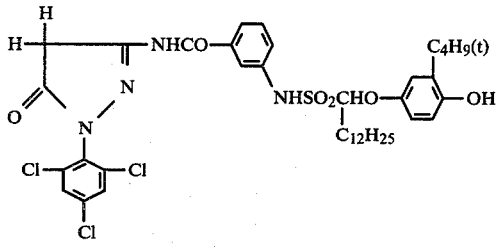
M - 23
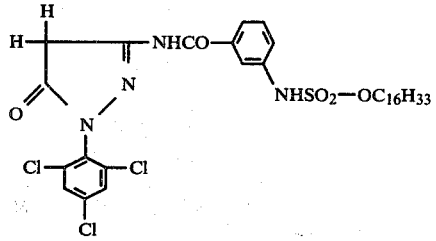
M - 24
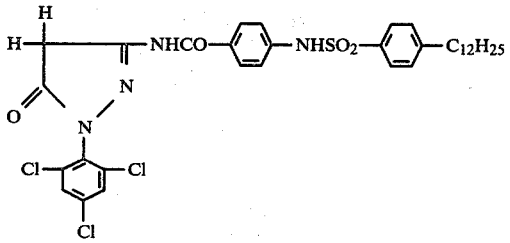
M - 25
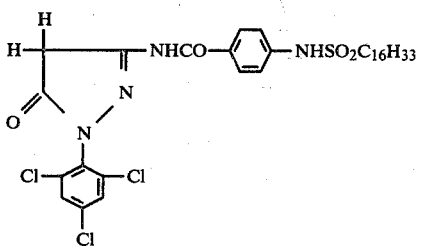
-continued
M - 26
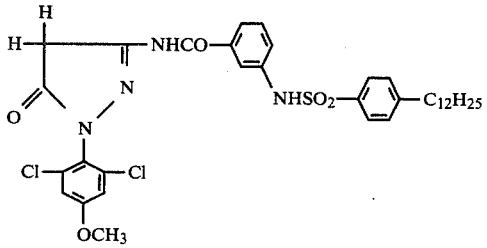
M - 27
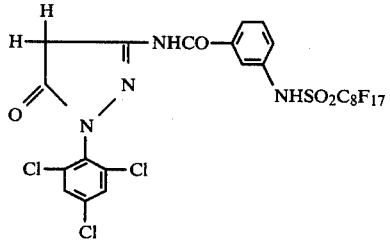
M - 28
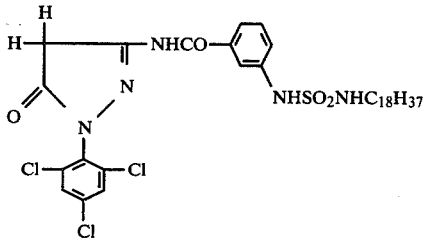
M - 29
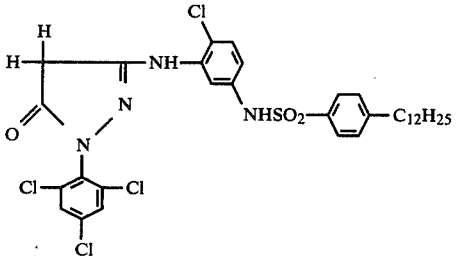
M - 30
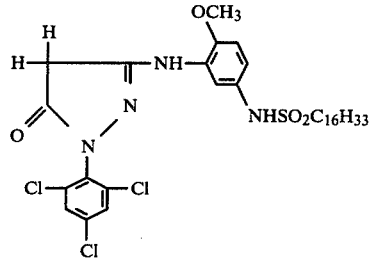
M - 31
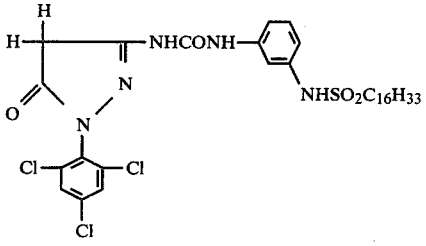

-continued
M - 32
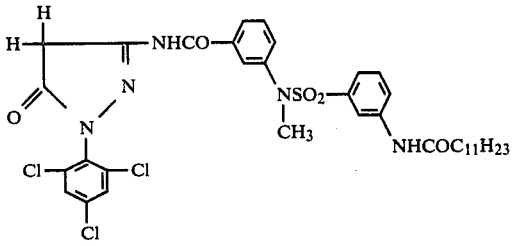
M - 33
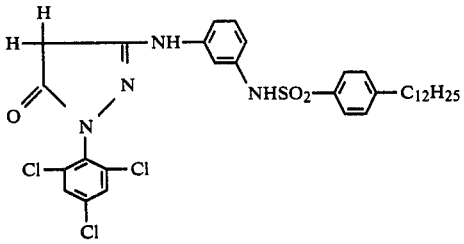
M - 34
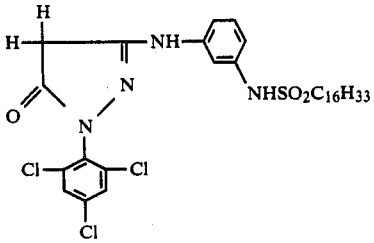
M - 35
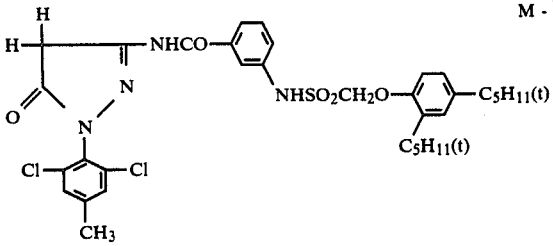
M - 36
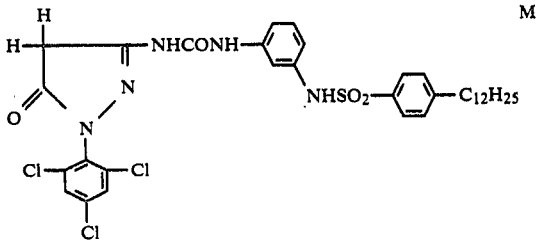
M - 37
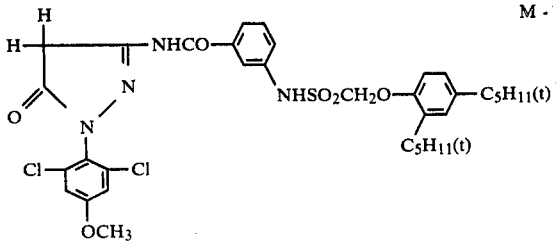
-continued
M - 38
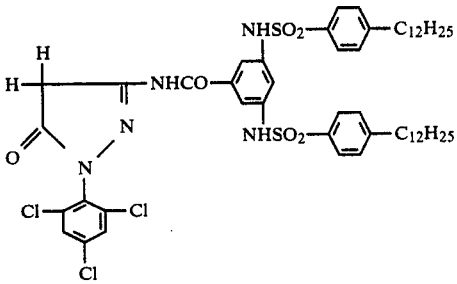
M - 39
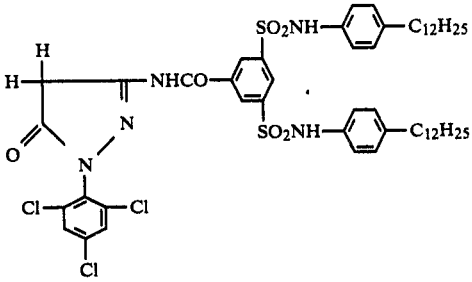
M - 40
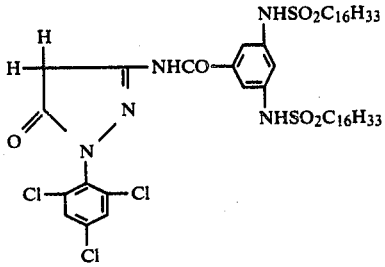
M - 41
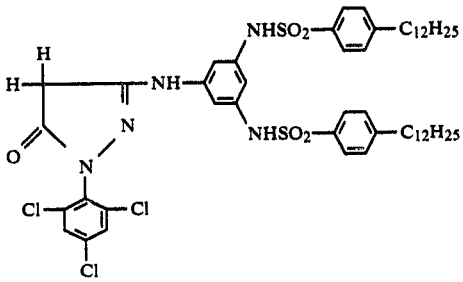
M - 42
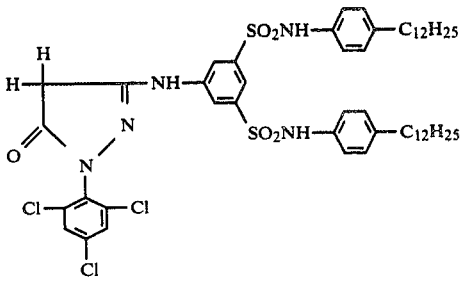

-continued
M - 43
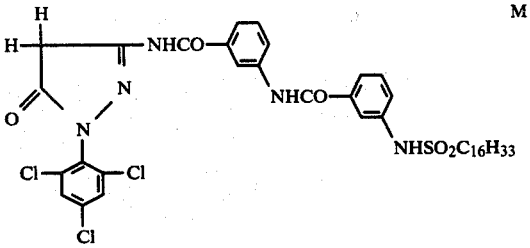
M - 44
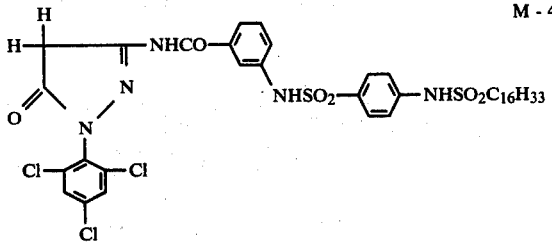
M - 45
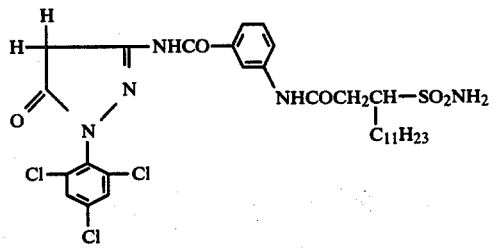
M - 46
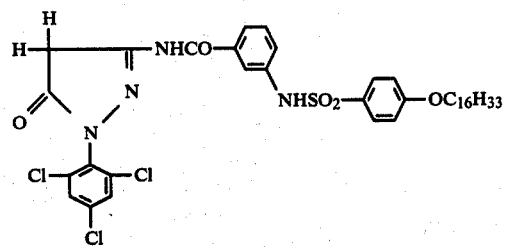
M - 47
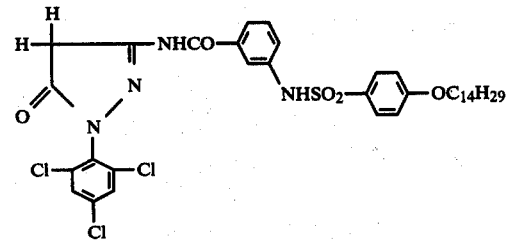
-continued
M - 48
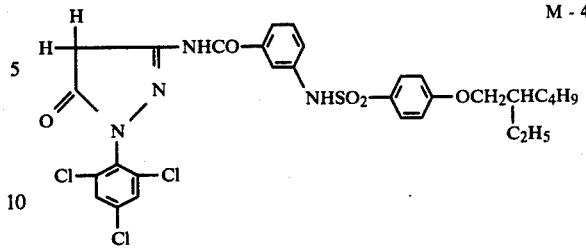
M - 49
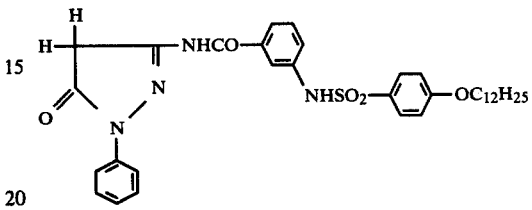
M - 50
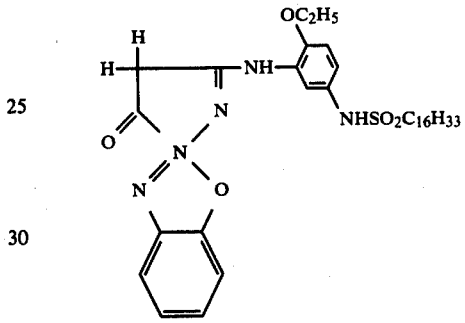
M - 51
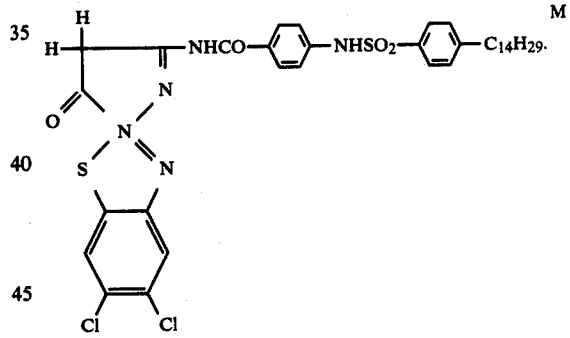
9. The material of claim 1 wherein said developer inhibitor releasing compound is selected from
D-1
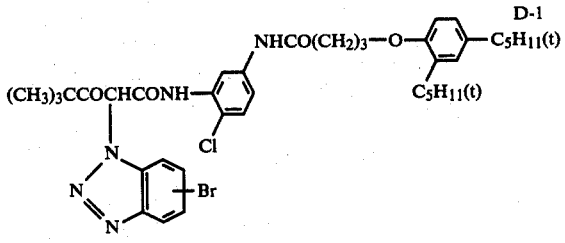
D-2
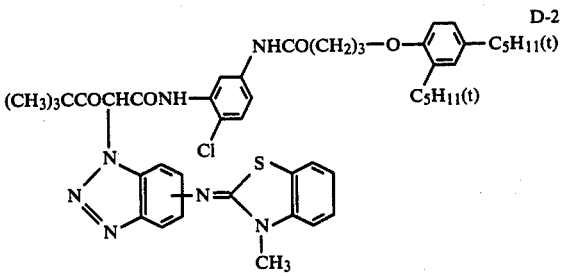

-continued
D-3
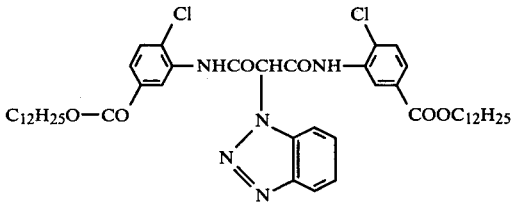
D-4
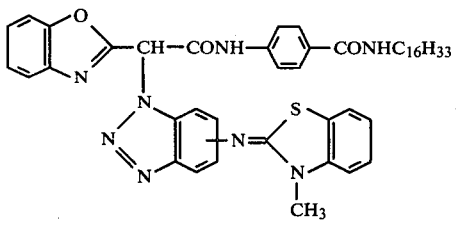
D-5
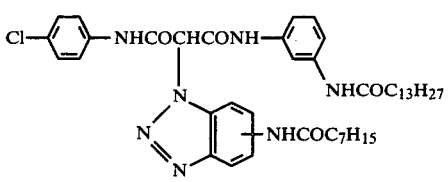
D-6
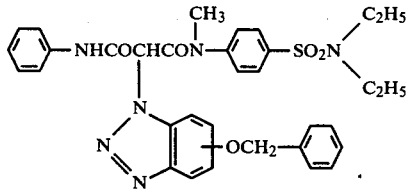
D-7
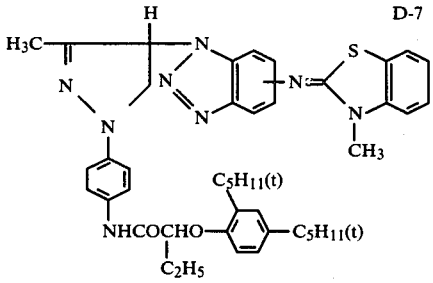
D-8
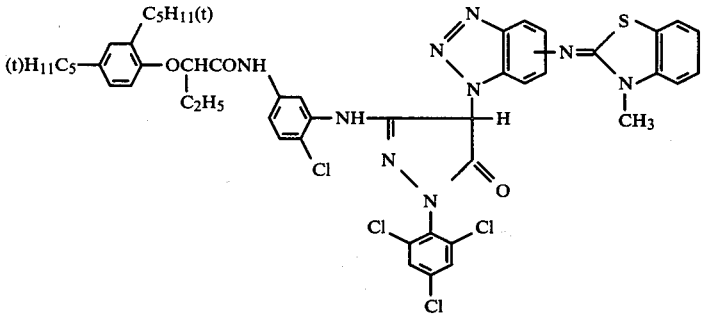
D-9
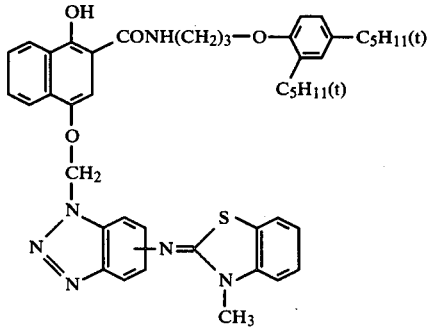
D-10
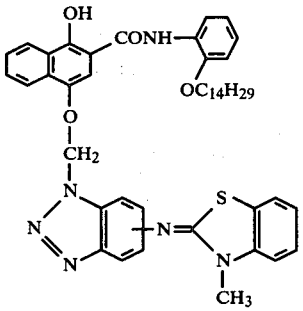
D-11
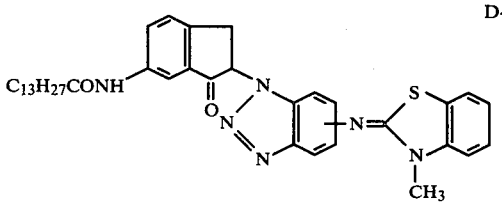
D-12
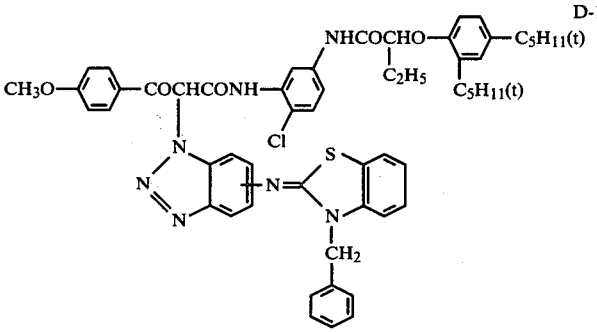

-continued
D-13
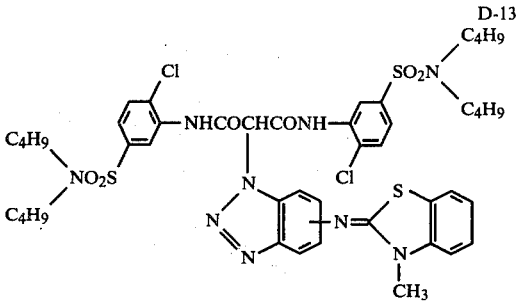
D-14
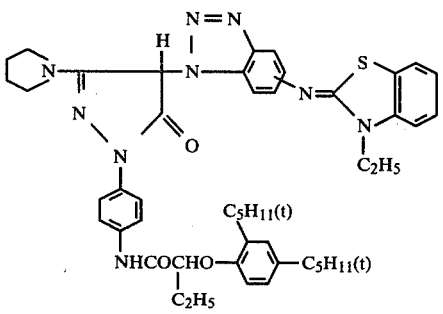
D-15
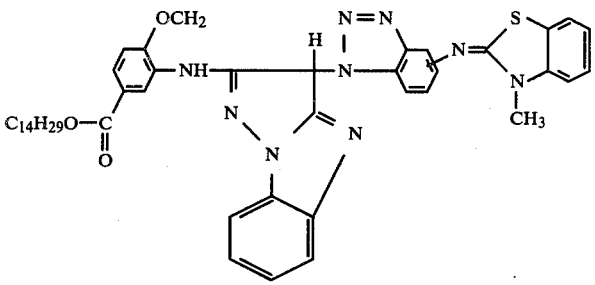
D-16
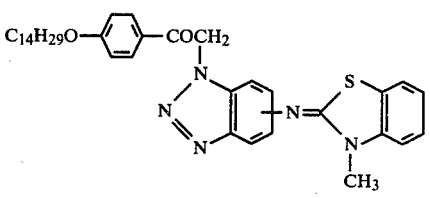
D-17
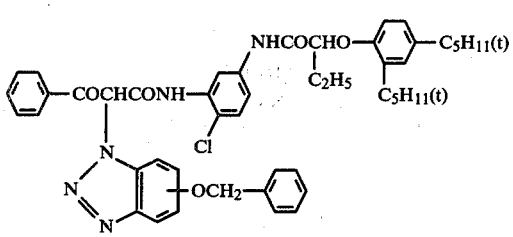
D-18
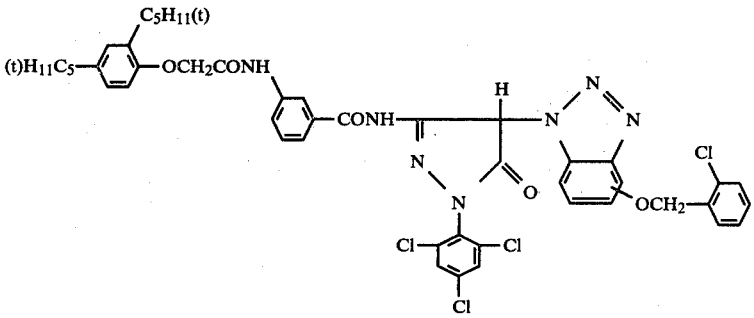
D-19
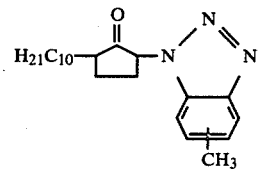
D-20
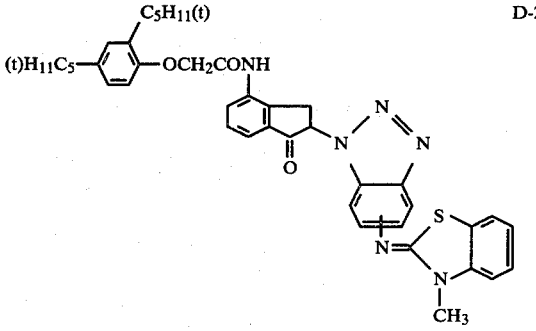
D-21
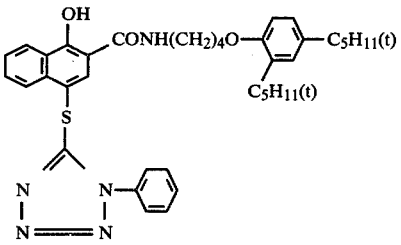

-continued
D-22
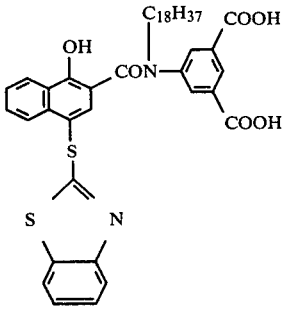
D-23
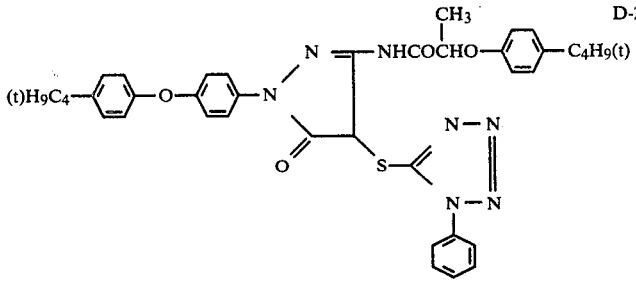
D-24
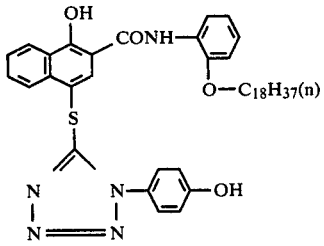
D-25
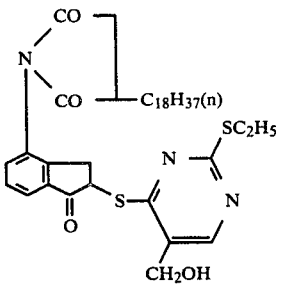
D-26
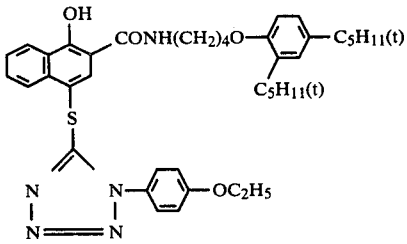
D-27
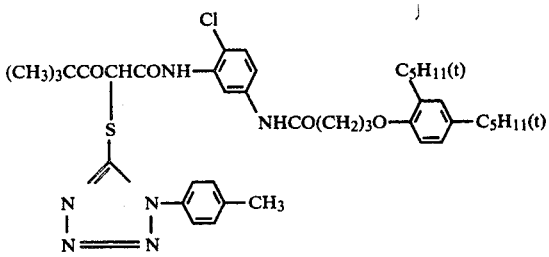
D-28
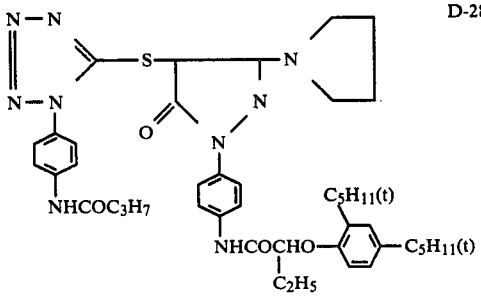
D-29
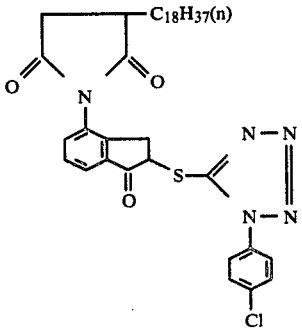
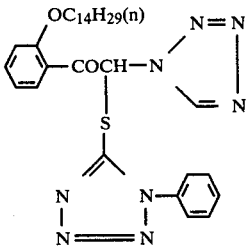
D-30
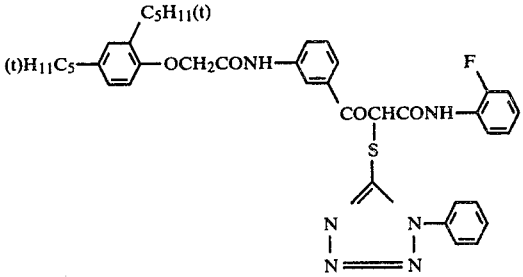
D-31

-continued
D-32
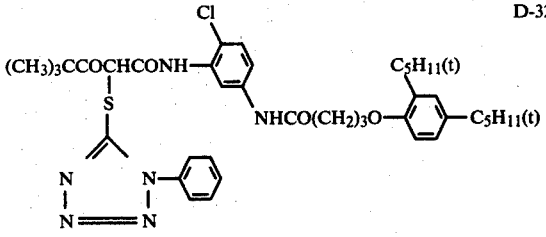
D-33
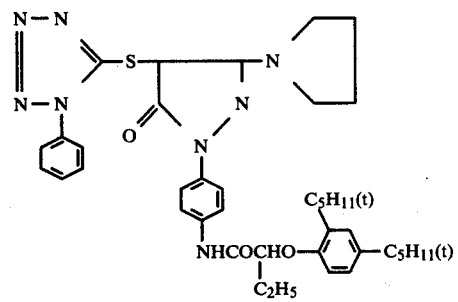
D-34
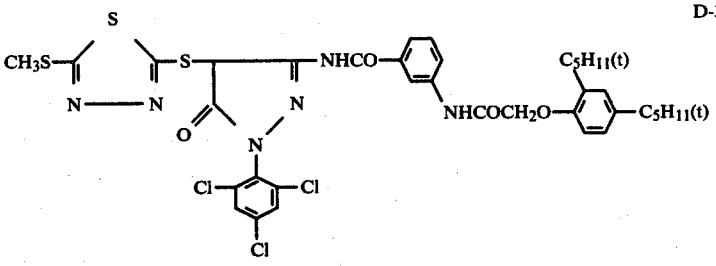
D-35
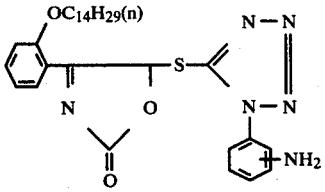
D-36
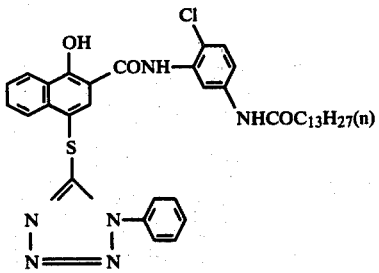
D-37
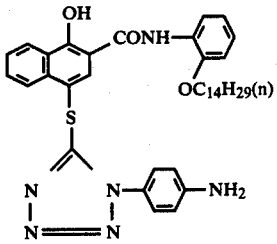
D-38
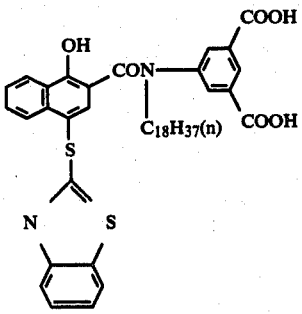
D-39
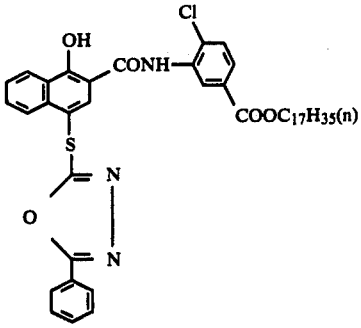
D-40
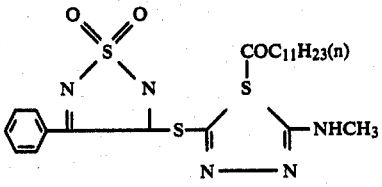
D-41
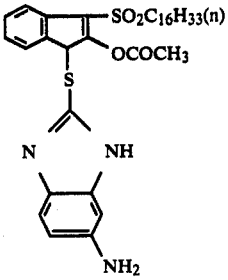

-continued
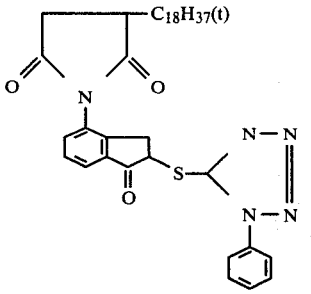
D-42
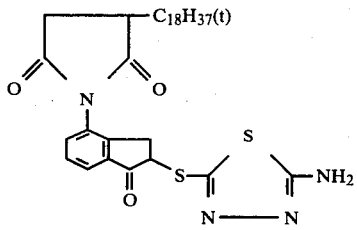
D-43
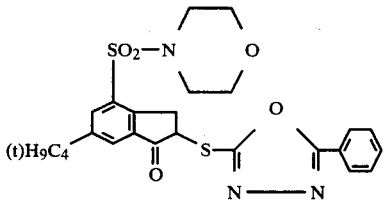
D-44
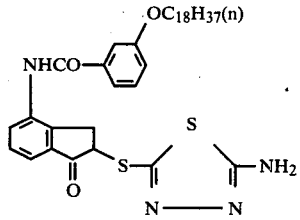
D-45
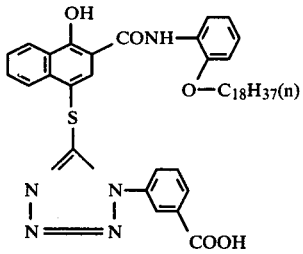
D-46
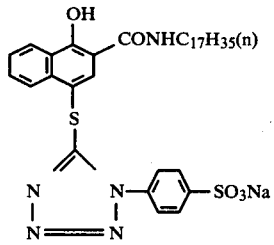
D-47
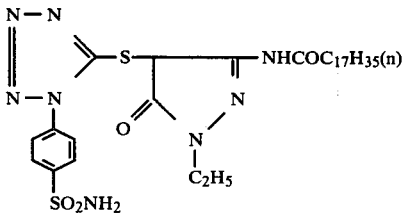
D-48
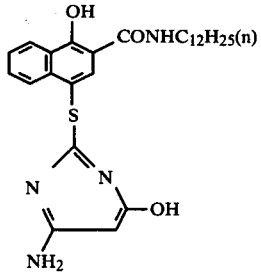
D-49
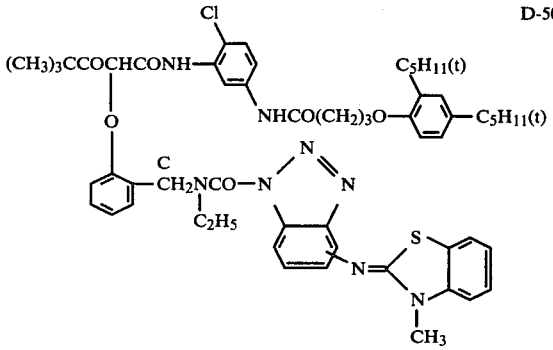
D-50
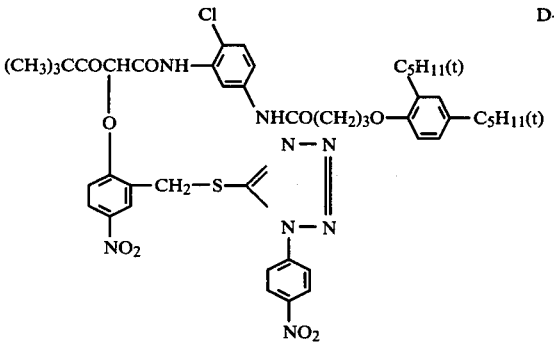
D-51

-continued
D-52
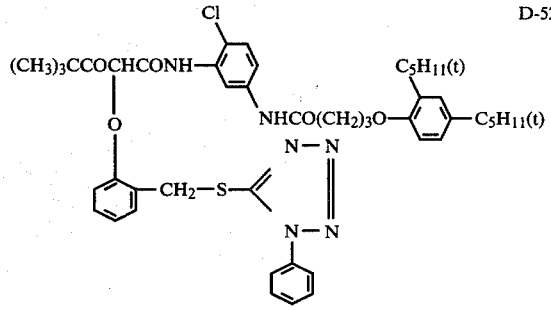
D-53
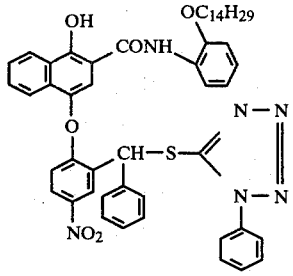
D-54
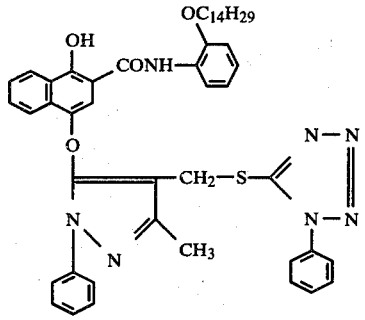
D-55
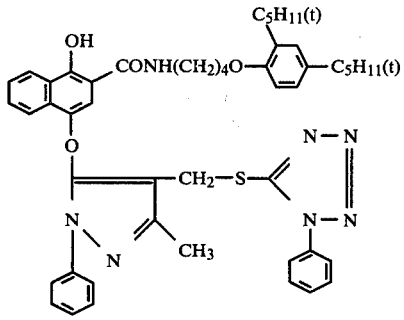
D-56
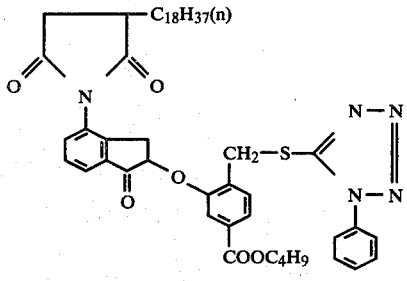
D-57
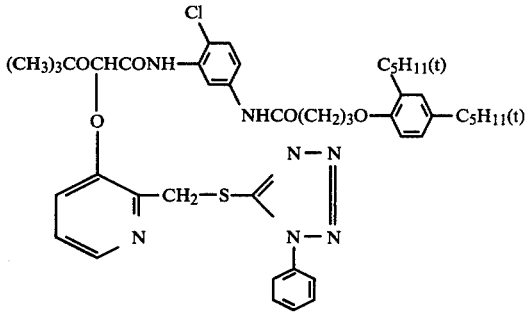
D-58
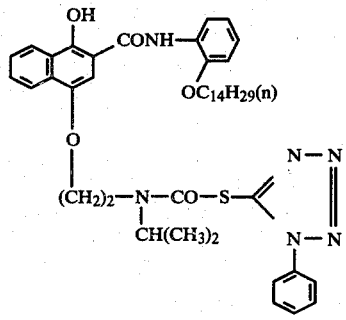
D-59
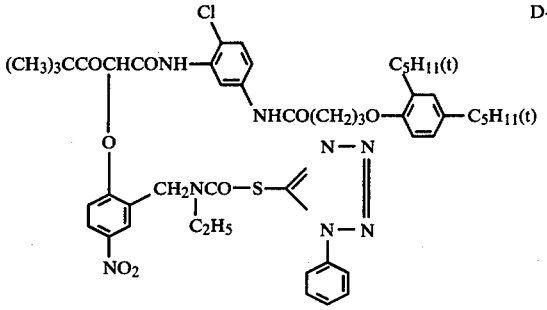
D-60
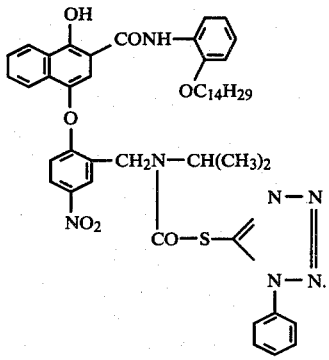

10. A silver halide color photographic light-sensitive material comprising a support and at least two coating layers thereon, at least one of said coating layers is a light sensitive silver halide emulsion layer, at least one of said coating layers is a non-light-sensitive hydrophilic colloidal layer, and at least one of said coating layers comprises at least one magenta coupler and at least one development inhibitor releasing compound, said magent coupler being selected from

M - 1

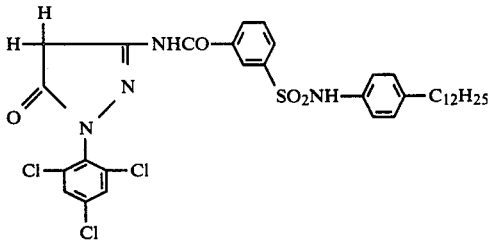

M - 2

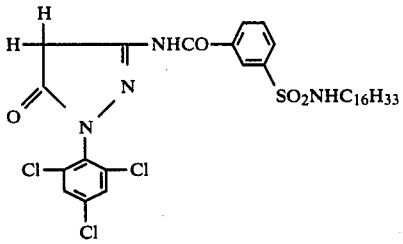

M - 3

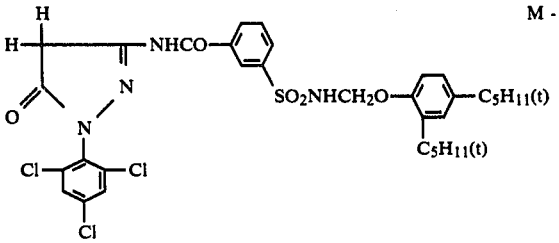

M - 4

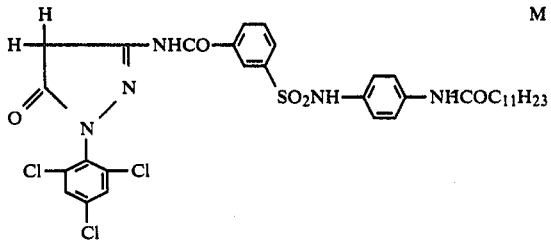

M - 5

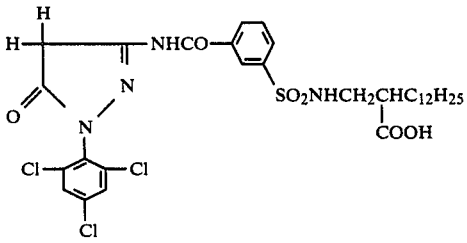

-continued

M - 6

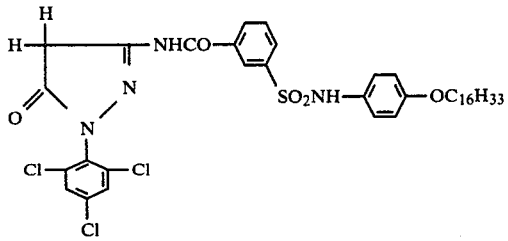

M - 7

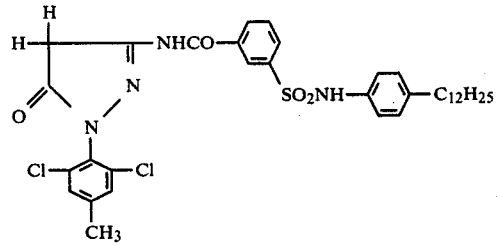

M - 8

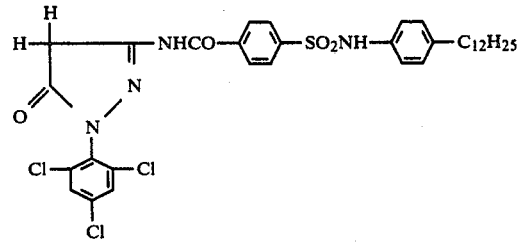

M - 9

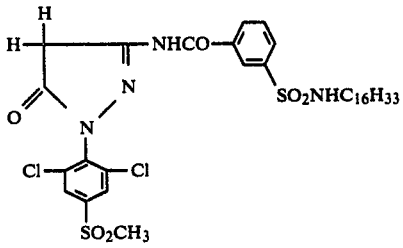

M - 10

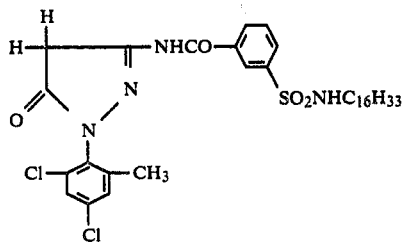

M - 11

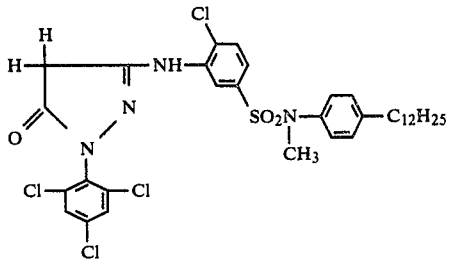

-continued
M - 12
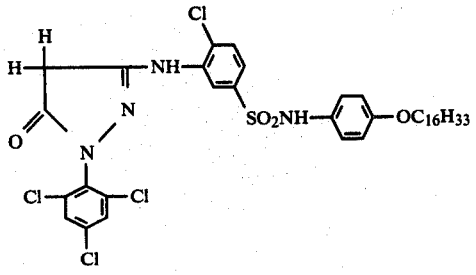
M - 13
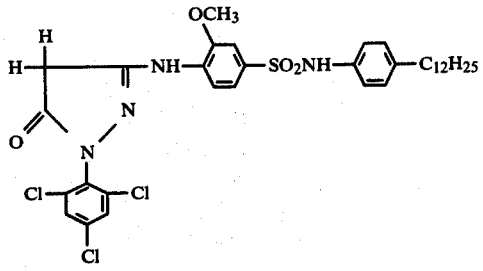
M - 14
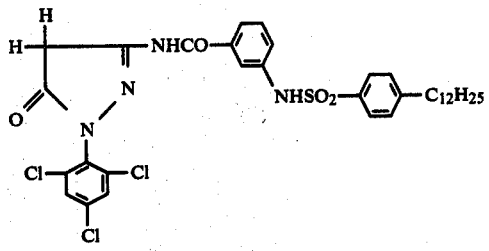
M - 15
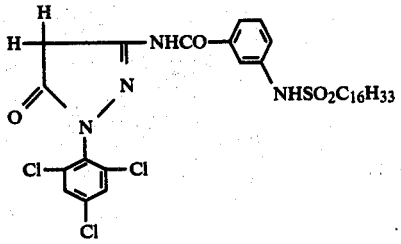
M - 16
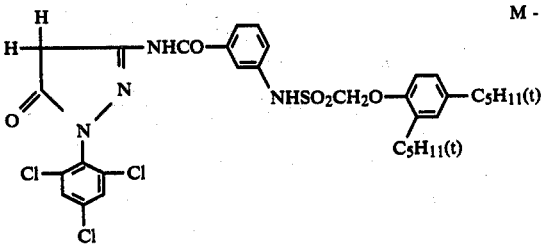
M - 17
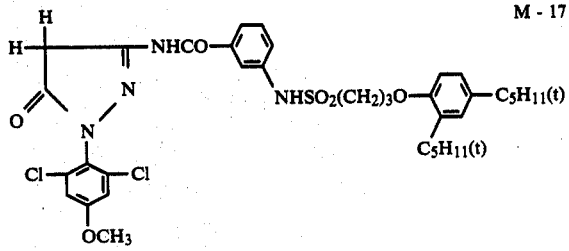
-continued
M - 18
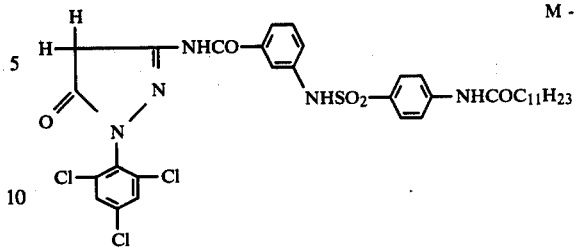
M - 19
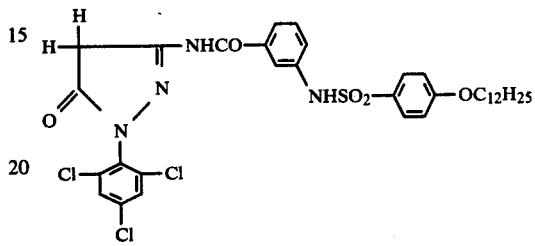
M - 20
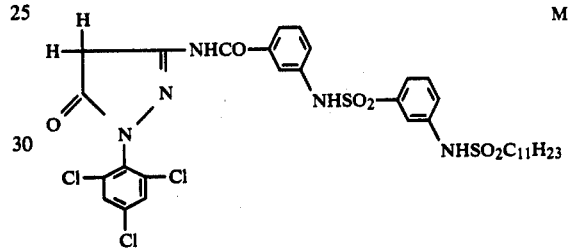
M - 21
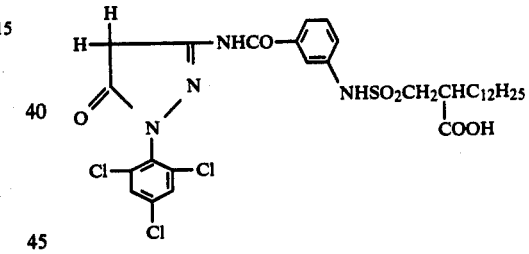
M - 22
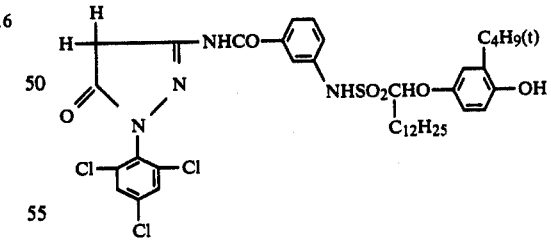
M - 23
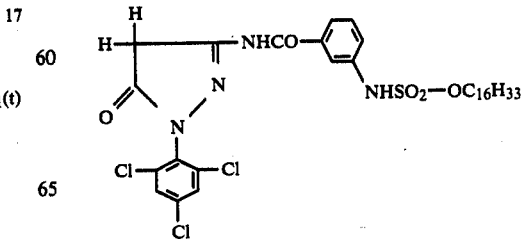

-continued
M - 24
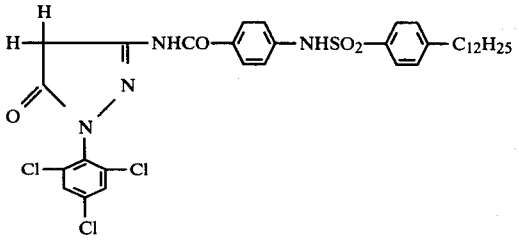
M - 25
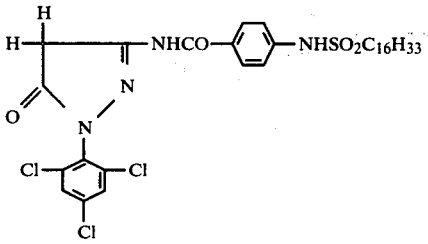
M - 26
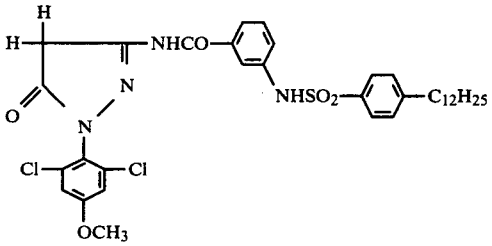
M - 27
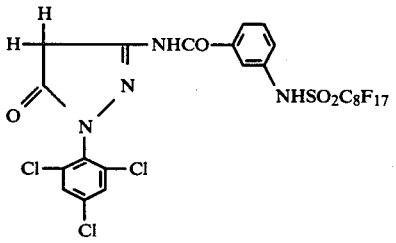
M - 28
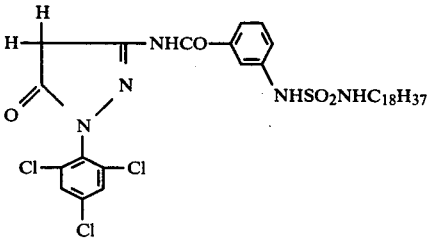
M - 29
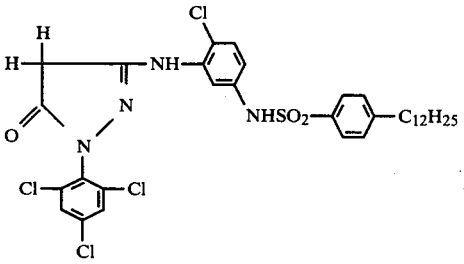
-continued
M - 30
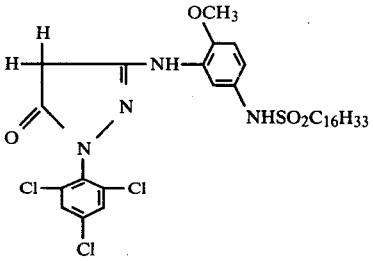
M - 31
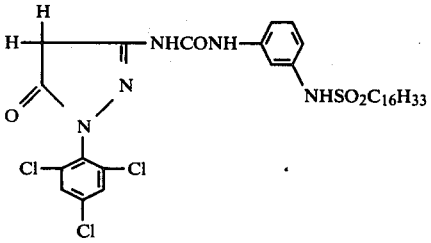
M - 32
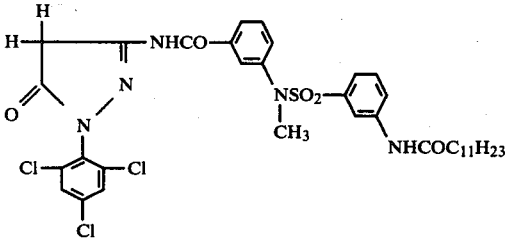
M - 33
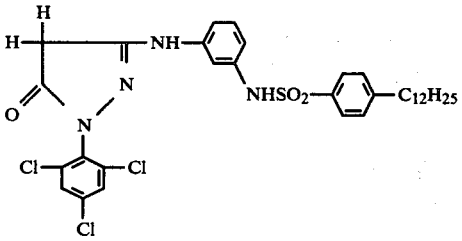
M - 34
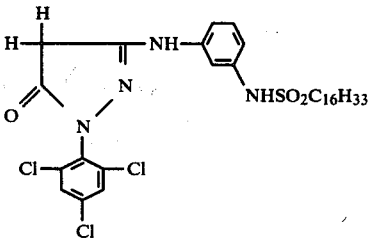
M - 35
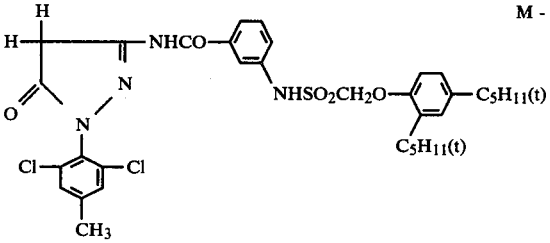

-continued
M - 36
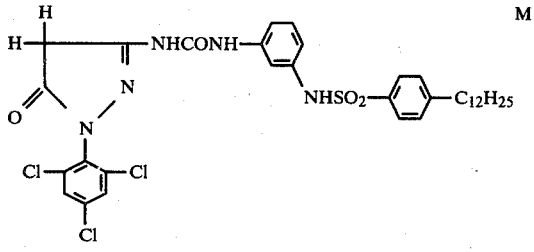
M - 37
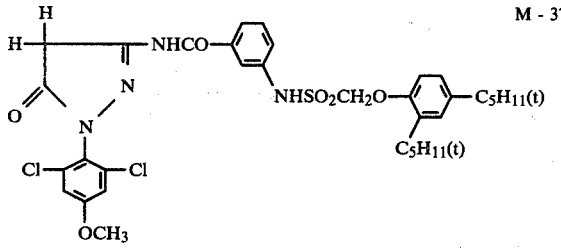
M - 38
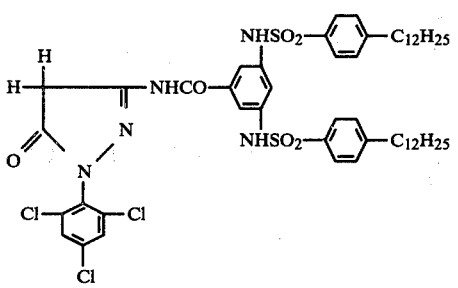
M - 39
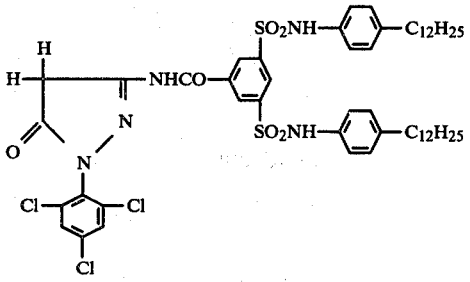
M - 40
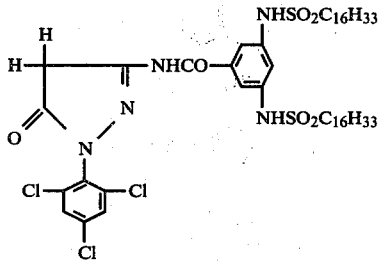
M - 41
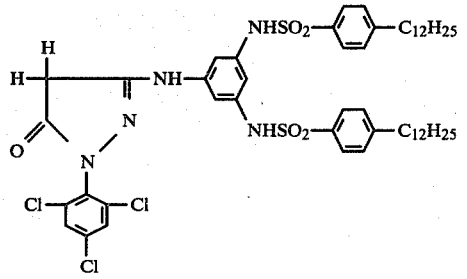
-continued
M - 42
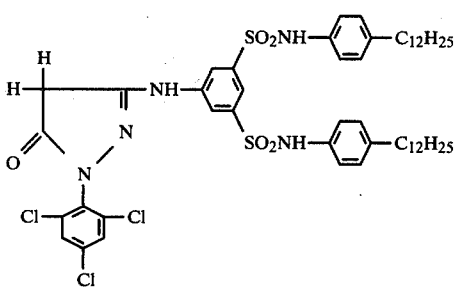
M - 43
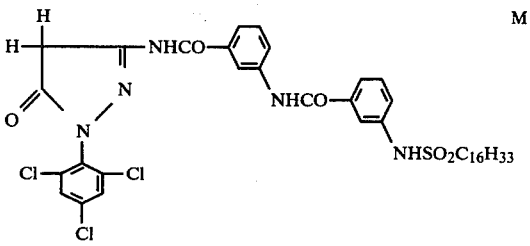
M - 44
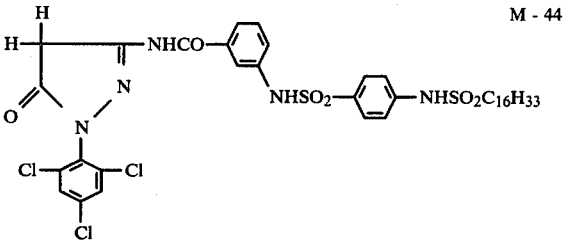
M - 45
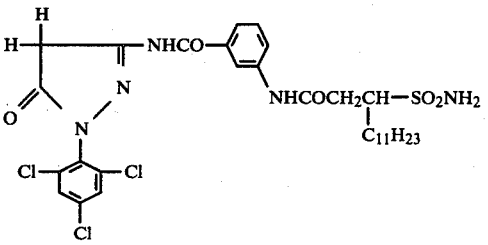
M - 46
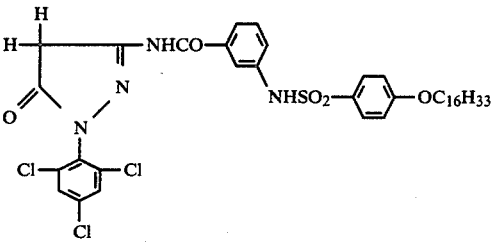
M - 47
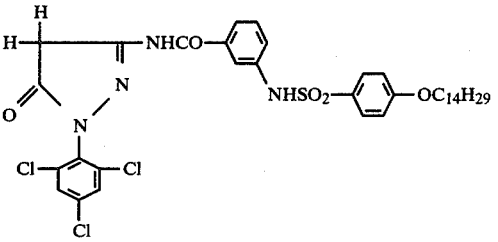

-continued
M - 48
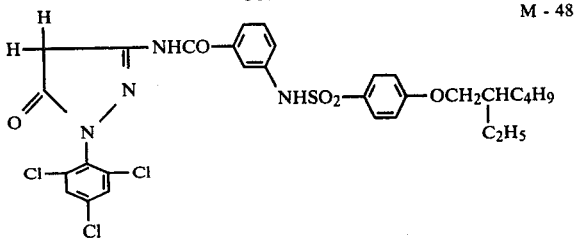
M - 49
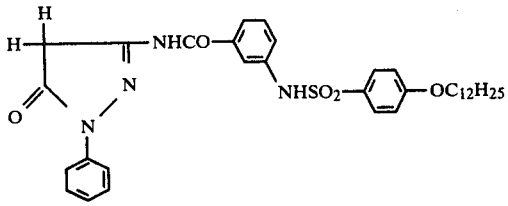
-continued
M - 50
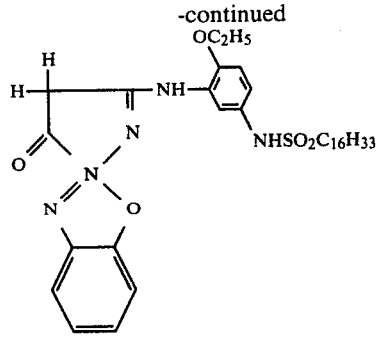
M - 51
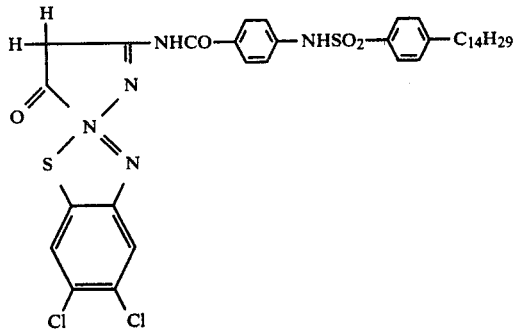
and said development inhibitor releasing compound being selected from
D-1
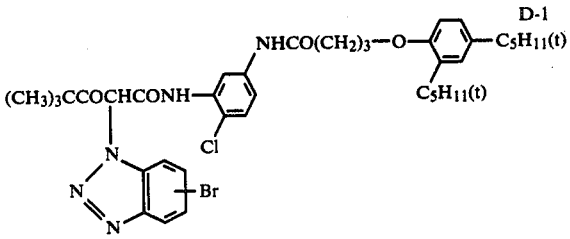
D-2
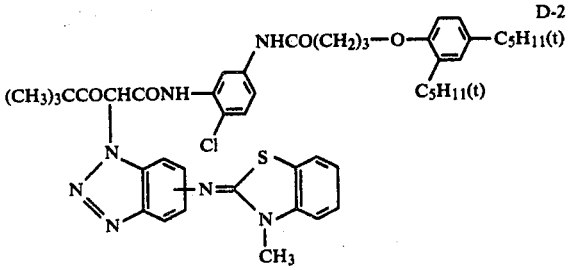
D-3
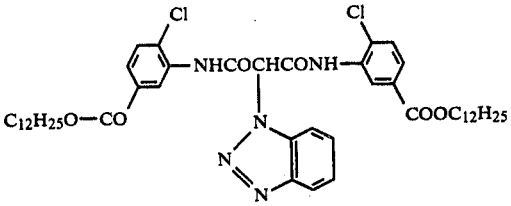
D-4
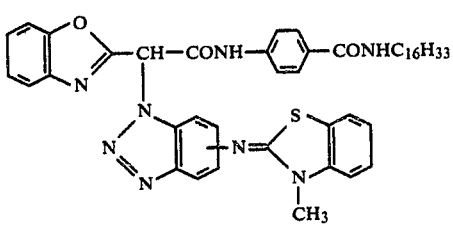
D-5
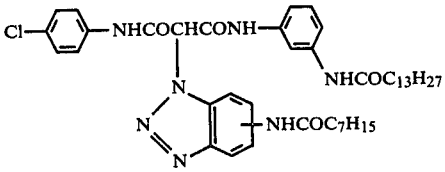
D-6
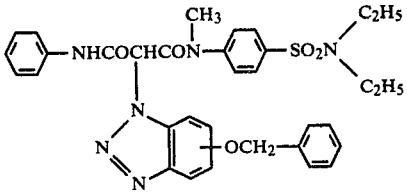

-continued
D-7
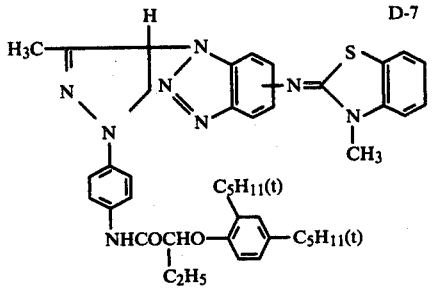
D-8
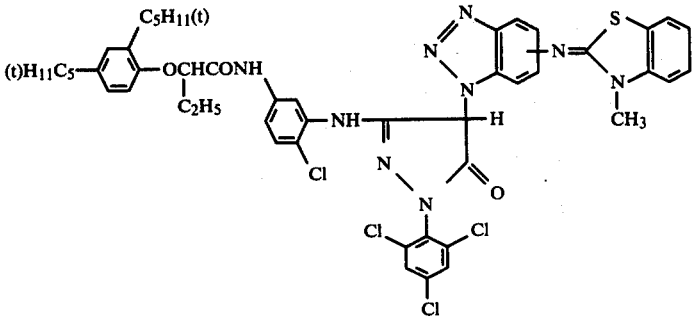
D-9
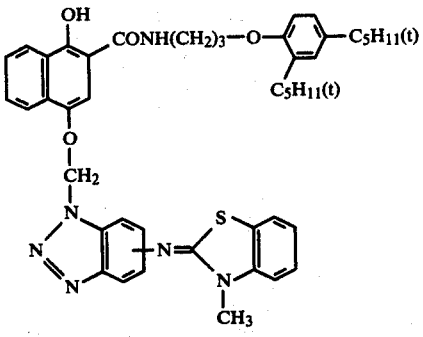
D-10
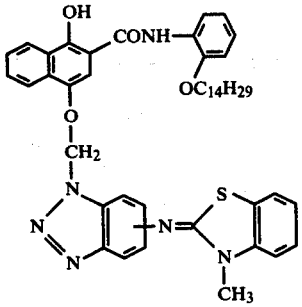
D-11
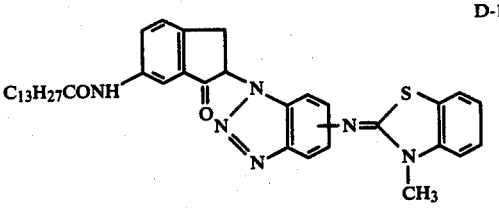
D-12
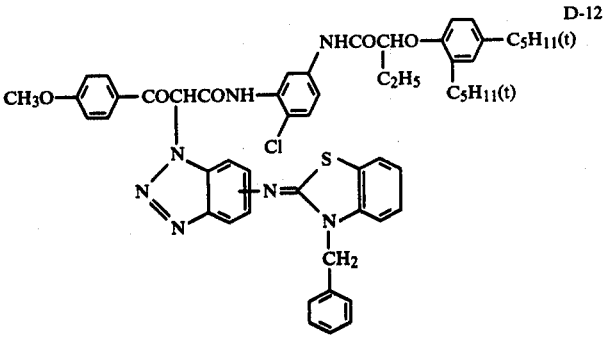
D-13
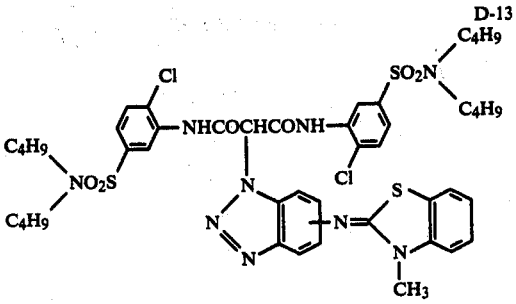
D-14
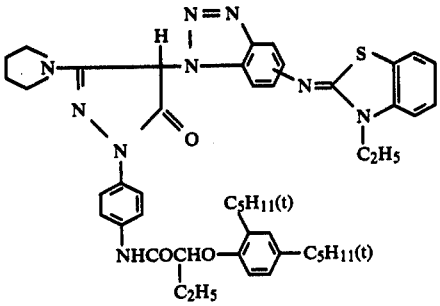
D-15
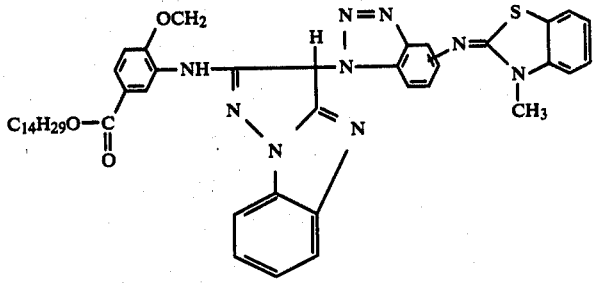
D-16
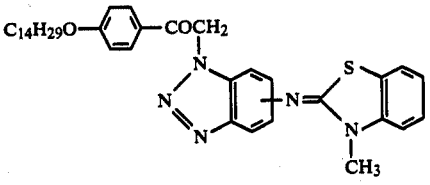

-continued
D-17
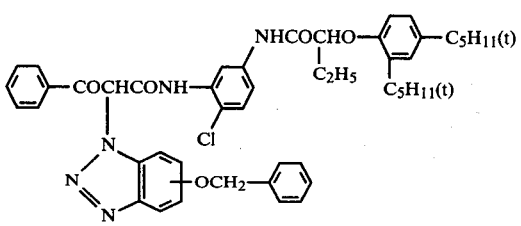
D-18
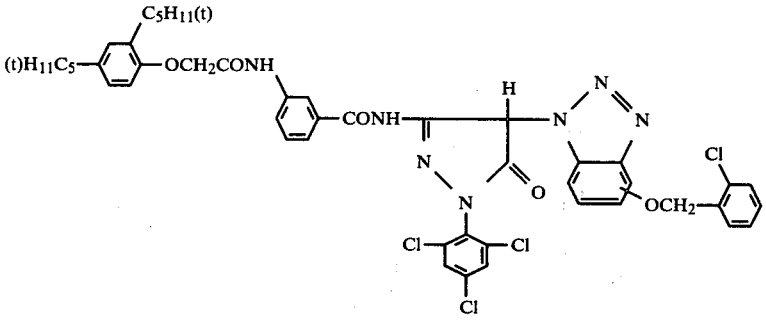
D-19
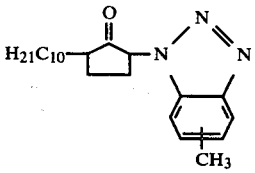
D-20
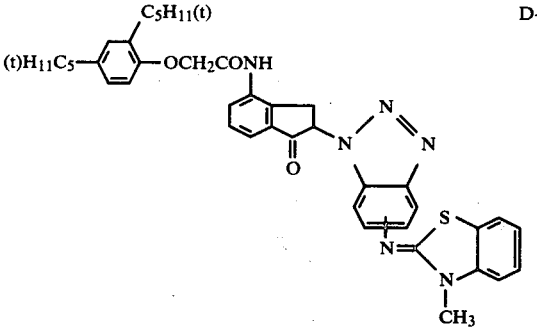
D-21
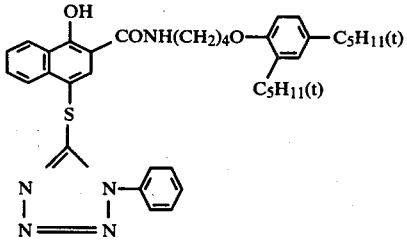
D-22
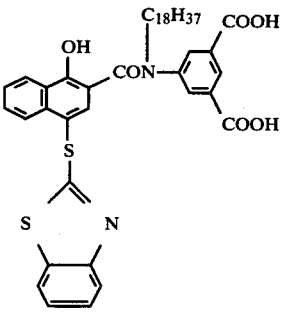
D-23
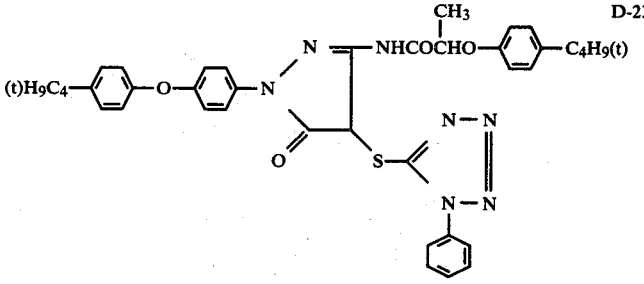
D-24
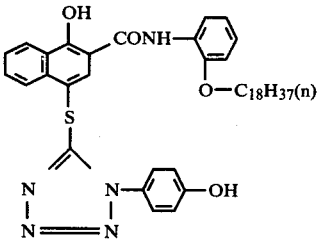
D-25
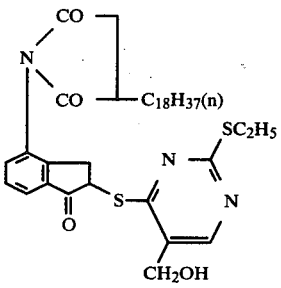

-continued
D-26
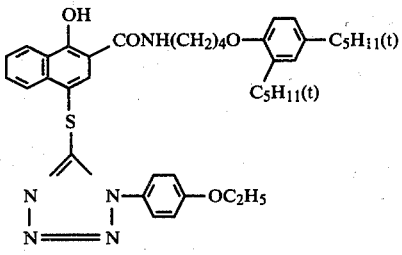
D-27
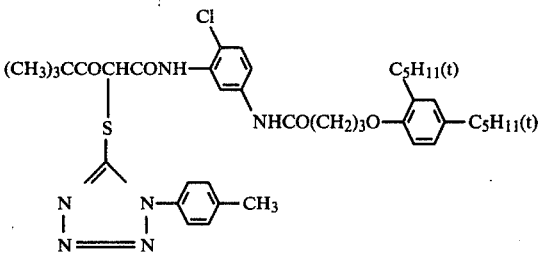
D-28
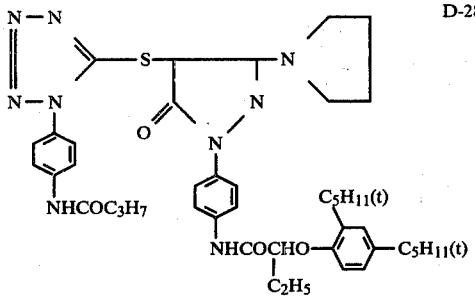
D-29
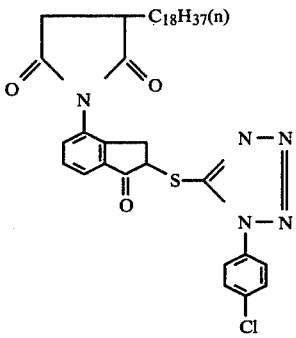
D-30
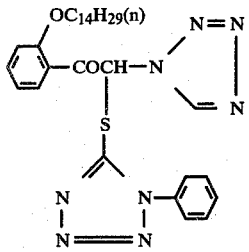
D-31
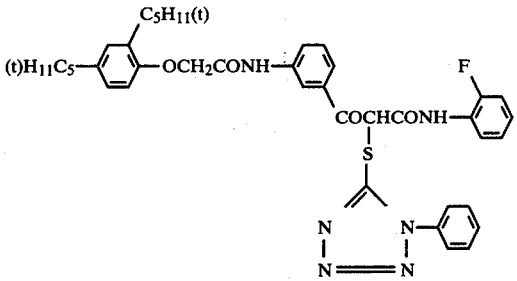
D-32
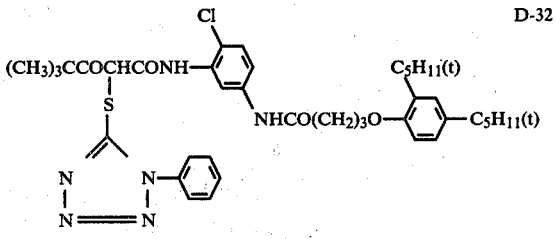
D-33
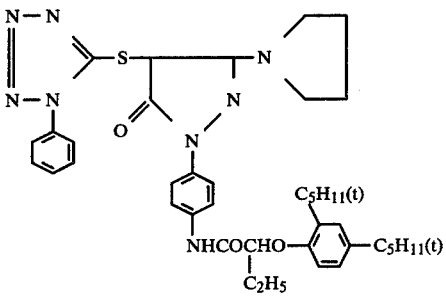
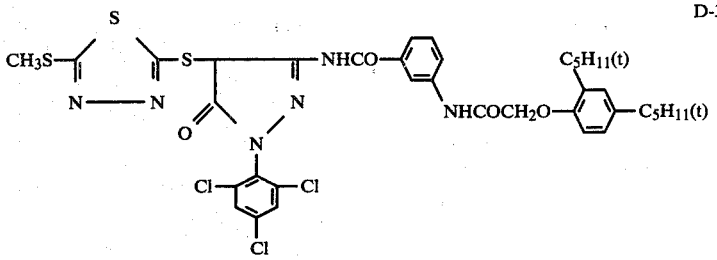
D-34
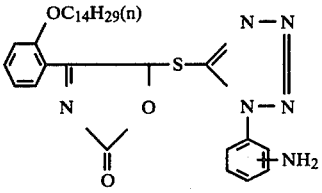
D-35

-continued
D-36
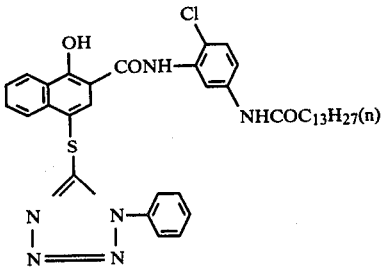
D-37
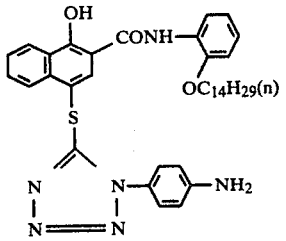
D-38
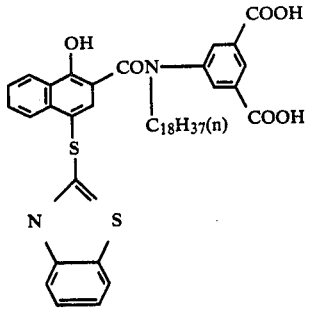
D-39
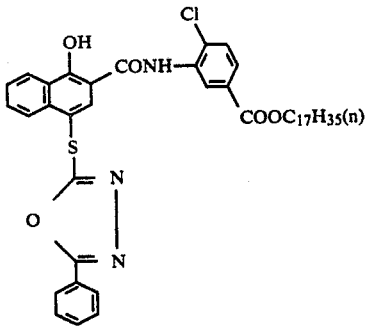
D-40
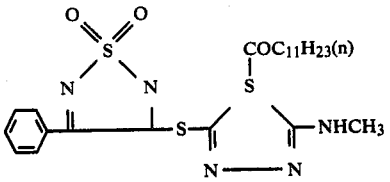
D-41
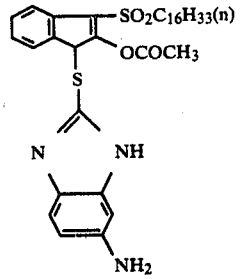
D-42
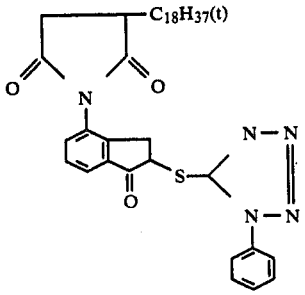
D-43
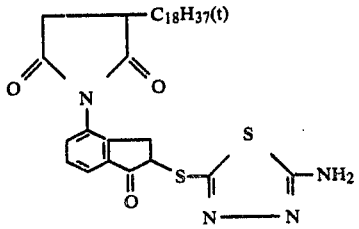
D-44
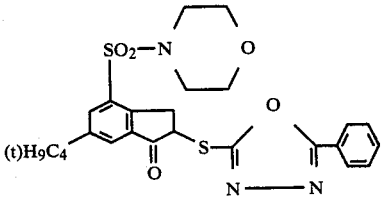
D-45
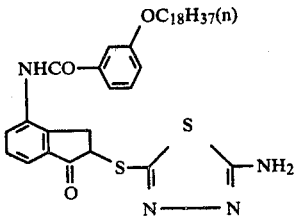

-continued
D-46
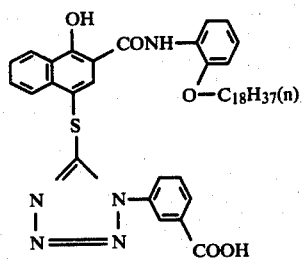
D-47
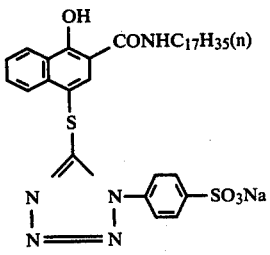
D-48
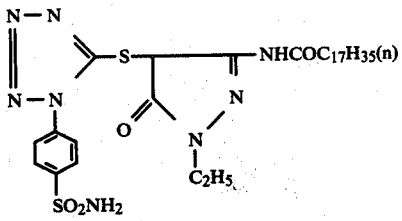
D-49
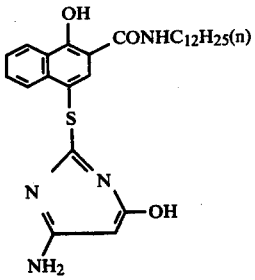
D-50
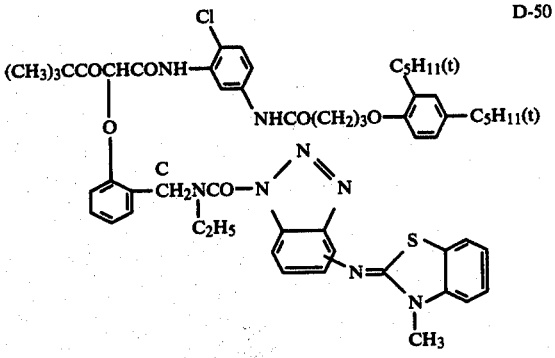
D-51
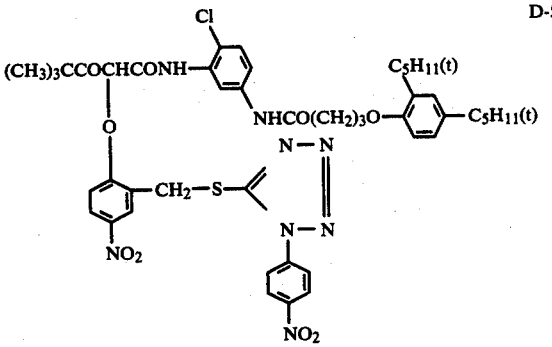
D-52
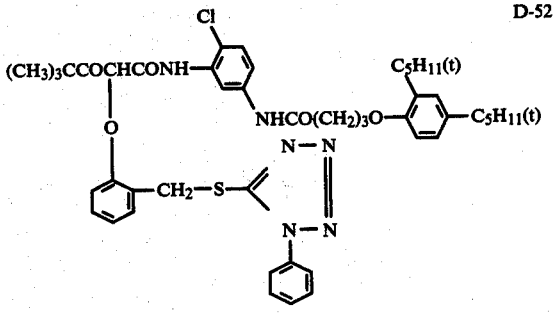
D-53
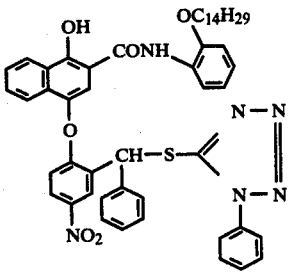
D-54
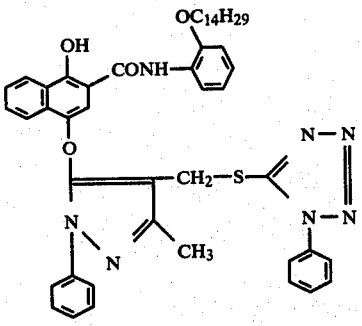
D-55
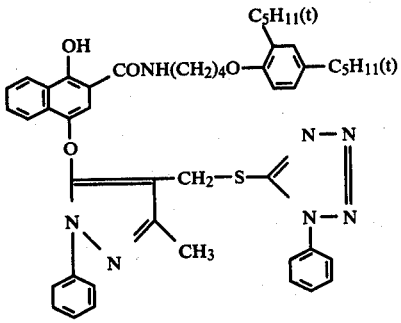

-continued
D-56
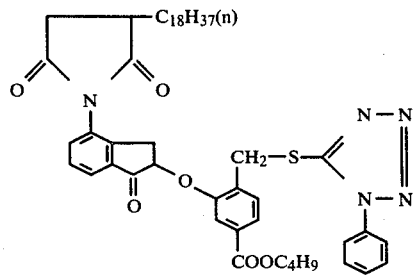
D-57
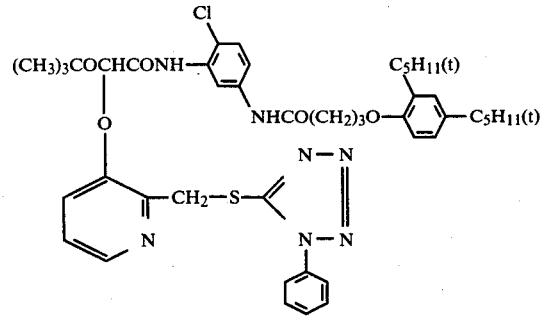
D-58
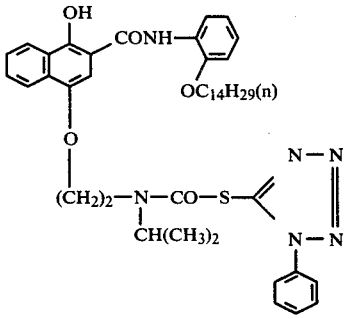
D-59
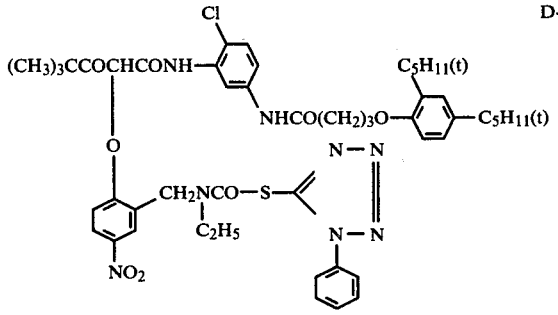
D-60
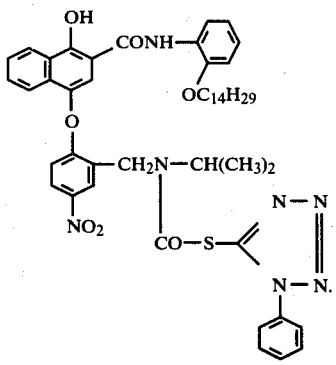
* * * * *